US008770801B1

(12) United States Patent
Berns et al.

(10) Patent No.: US 8,770,801 B1
(45) Date of Patent: Jul. 8, 2014

(54) APPARATUS AND METHOD FOR PATHWAY OR SIMILAR LIGHTING

(75) Inventors: James J. Berns, Muscatine, IA (US); Lawrence H. Boxler, Oskaloosa, IA (US); Matthew D. Drost, Oskaloosa, IA (US); Chris P. Lickiss, Newton, IA (US); Joel D. Rozendaal, Lynnville, IA (US); Thomas A. Stone, Univeristy Park, IA (US)

(73) Assignee: Musco Corporation, Oskaloosa, IA (US)

( * ) Notice: Subject to any disclaimer, the term of this patent is extended or adjusted under 35 U.S.C. 154(b) by 181 days.

(21) Appl. No.: 13/078,301

(22) Filed: Apr. 1, 2011

Related U.S. Application Data

(63) Continuation-in-part of application No. 12/113,838, filed on May 1, 2008, now Pat. No. 7,976,199.

(60) Provisional application No. 60/915,158, filed on May 1, 2007, provisional application No. 61/321,394, filed on Apr. 6, 2010.

(51) Int. Cl.
*F21V 3/00* (2006.01)
*F21V 5/00* (2006.01)
*F21V 7/00* (2006.01)

(52) U.S. Cl.
USPC ..... 362/311.02; 362/311.01; 362/310; 362/296.01; 362/341

(58) Field of Classification Search
USPC ..... 362/298, 311.01–311.05, 543–549, 362/555, 800, 249.01–249.03, 431, 153, 362/234, 241, 245, 235, 362, 351, 362/249.01–249.02, 277–279, 290–291
See application file for complete search history.

(56) References Cited

U.S. PATENT DOCUMENTS

| | | | |
|---|---|---|---|
| 1,991,584 | A | 2/1935 | Strauss |
| 4,663,698 | A | 5/1987 | Tomlinson |
| 4,719,548 | A | 1/1988 | Orosz |
| 5,067,062 | A | 11/1991 | Rulke |
| 5,075,833 | A | 12/1991 | Dormand |
| 5,105,347 | A | 4/1992 | Ruud et al. |
| 5,134,550 | A | 7/1992 | Young |

(Continued)

FOREIGN PATENT DOCUMENTS

| | | | |
|---|---|---|---|
| GB | 193515 | A | 2/1923 |
| GB | 536563 | A | 5/1941 |

(Continued)

OTHER PUBLICATIONS

Arcadian Lighting, "Bollards and Pagoda Lights at Deep Discount", http://www.arcadianlighting.com/bollard-and-pagoda-lights.html, retrieved Apr. 29, 2007, 4 pages.

(Continued)

*Primary Examiner* — Donald Raleigh
(74) *Attorney, Agent, or Firm* — McKee, Voorhees & Sease

(57) ABSTRACT

An apparatus, method, and system for lighting target areas with bollard or pagoda-type lights in a controlled and efficient manner. The apparatus includes a housing with a light source, optic system, and a control circuit. The light source and optic system are configured to produce a highly controlled output beam pattern and shield from normal viewing angles direct sight of the source. This enables control of glare and spill light which can improve effectiveness, efficiency, and energy usage.

18 Claims, 50 Drawing Sheets

(56) References Cited

U.S. PATENT DOCUMENTS

| | | | | |
|---|---|---|---|---|
| 5,906,425 | A | 5/1999 | Gordin et al. | |
| 5,921,663 | A | 7/1999 | Flammer | |
| 6,402,337 | B1 * | 6/2002 | LeVasseur et al. | 362/153.1 |
| 6,457,847 | B1 * | 10/2002 | LeVasseur | 362/351 |
| 6,530,675 | B1 * | 3/2003 | Van Etten | 362/267 |
| 6,543,911 | B1 | 4/2003 | Rizkin et al. | |
| 6,679,621 | B2 | 1/2004 | West et al. | |
| 6,814,470 | B2 | 11/2004 | Rizkin et al. | |
| 6,899,443 | B2 | 5/2005 | Rizkin et al. | |
| 6,951,418 | B2 | 10/2005 | Rizkin et al. | |
| 6,971,772 | B1 | 12/2005 | Abdelsamed et al. | |
| 7,246,921 | B2 | 7/2007 | Jacobson et al. | |
| 7,425,084 | B2 * | 9/2008 | Ruud et al. | 362/298 |
| 7,503,669 | B2 | 3/2009 | Rizkin et al. | |
| 7,618,163 | B2 | 11/2009 | Wilcox | |
| 7,744,246 | B2 | 6/2010 | Rizkin et al. | |
| 7,798,684 | B2 * | 9/2010 | Boissevain | 362/431 |
| 7,976,199 | B2 | 7/2011 | Berns et al. | |
| 2002/0118542 | A1 | 8/2002 | LeVasseur | |
| 2006/0092638 | A1 * | 5/2006 | Harwood | 362/249 |
| 2008/0030987 | A1 * | 2/2008 | Simon | 362/234 |
| 2008/0037239 | A1 | 2/2008 | Thomas et al. | |
| 2008/0084697 | A1 | 4/2008 | Eberhard | |
| 2008/0192480 | A1 | 8/2008 | Rizkin et al. | |
| 2008/0273333 | A1 | 11/2008 | Berns et al. | |
| 2009/0284966 | A1 | 11/2009 | Crookham et al. | |
| 2010/0103672 | A1 | 4/2010 | Thomas et al. | |
| 2010/0290225 | A1 | 11/2010 | Rizkin et al. | |
| 2011/0083460 | A1 | 4/2011 | Thomas et al. | |

FOREIGN PATENT DOCUMENTS

| | | | |
|---|---|---|---|
| WO | WO 01/86198 | A1 | 11/2001 |
| WO | W2008/123960 | A1 | 10/2008 |
| WO | WO 2008/123960 | A1 | 10/2008 |
| WO | WO 2010/042186 | A2 | 4/2010 |

OTHER PUBLICATIONS

Philips, Technical Datasheet DS25 "Power Light Source LUXEON EMITTER", http://www.philipslunnileds.com/pdfs/DS25.pdf, May 2007, 19 pages.

LUXDRIVE by LEDdynamics, "3021/3023 BuckPuck Wide Range LED Power Module", http://www.leddynamics.com/LuxDrive/datasheets/3021-BuckPuck/pdf, Document COM-DRV-3021-00, Jul. 2005, 8 pages.

LUXEON, Application Brief AB05 "Thermal Design Using LUXEON Power Light Sources", http://www.philipsSlumileds.com/pdfs/AB05.pdf, Jun. 2006, 12 pages.

Philips, "Luxeon LED Radiation Patterns::Light Distribution Patterns", www.lumileds.com/technology/radiationpatterns.cfm, retrieved Apr. 28, 2007, 1 page.

Cree "Cree® XLamp® XP-E LEDs", Product Family Data Sheet, CLD-DS18 REV 12, pp. 1-16, 2008-2010.

Anomet exclusive Canadian Representation of Anolux MIRO®, "MIRO", printed from Internet on Aug. 9, 2011 at http://www.anomet.com/miro.html, 2 pages.

MUSCO Lighting "Control-Link® Facility Management System", printed from Internet on Aug. 9, 2011 at http://www.musco.com/clink/controlsystems.html, 1 page.

* cited by examiner (BOLLARD - TYPE HOUSING)

(WALL MOUNT-TYPE HOUSING)

(SIDE VIEW BOLLARD - TYPE HOUSING; POST ONLY)

(FRONT VIEW OF FIGURE 4A)

(SIDE VIEW OF WALL MOUNT - TYPE HOUSING; POST ONLY)

(FRONT VIEW OF FIGURE 4C)

(FRONT VIEW OF HEAT SINK)

(TOP VIEW OF HEAT SINK)

(SIDE VIEW OF HEAT SINK)

(TOP VIEW OF CIRCUIT BOARD)

(TOP VIEW)

(SIDE VIEW)
(RIGHT SIDE BRACKET)

(TOP VIEW)

(SIDE VIEW)
(LEFT SIDE BRACKET)

(TOP VIEW)

(FRONT VIEW)

(TOP VIEW)

(FRONT VIEW)

ASSEMBLED

EXPLODED VIEW (SECTION VIEW)

TOP VIEW

FRONT VIEW

SIDE VIEW

SIDE VIEW

DETAIL C-C

BACK VIEW-TILTED DOWN

BACK VIEW-TILTED UP

APPARATUS AND METHOD FOR PATHWAY OR SIMILAR LIGHTING

CROSS-REFERENCE TO RELATED APPLICATIONS

This application claims priority under 35 U.S.C. §119 of provisional application U.S. Ser. No. 61/321,394 filed Apr. 6, 2010, and this application is a continuation-in-part of application U.S. Ser. No. 12/113,838 filed May 1, 2008, now U.S. Pat. No. 7,976,199, which claims priority to provisional application U.S. Ser. No. 60/915,158 filed May 1, 2007, each of which applications are hereby incorporated by reference in their entirety.

I. BACKGROUND OF INVENTION

A. Field of Invention

The present invention relates to highly efficient lighting fixtures and methods that provide a light beam pattern suitable for illuminating pathways, walkways, and similar area lighting.

B. Problems in the Art

Many different types of light fixtures exist for the application of lighting pathways. Some of these include bollard, pagoda, or landscaping lights, and the like. These lights use different types of light sources ranging from incandescent to halogen to LEDs (light emitting diodes).

Most of the light sources use lamp wattages in the range of 20 watts or more. The lumen output per watt can be lower than desired, however, often in the range of 10-12 lumens per watt. Thus, the amount of light available on the surface to be lighted is limited unless the lamp wattage is increased, which would increase energy consumption. Therefore, energy efficiency is an issue.

Another problem in this field is that light from the fixture is generally not controlled or is poorly controlled. In other words, substantial light from the fixture does not usefully help light the defined target area. It either falls outside the target or is not useful to illuminate the area. This results in wasted light that does not contribute to the area to be illuminated, as well as creates a potential source of glare and spill light.

A common fixture design for a bollard light or pagoda light comprises a vertical post with the light source mounted near the top and surrounded by a transparent lens. An additional feature may include baffles to help direct the light downward. However, with these fixtures, typically more than 50 percent of the light is wasted as it is directed or travels away from the area to be illuminated. This wasted light not only consumes energy, but distracts from the visual appearance of the target (e.g., pathway) by illuminating areas outside of the target boundaries (e.g., sides of a pathway).

Glare or spill light as a result of light that is poorly controlled is a concern for many lighting designers and viewers. When the light is not controlled or confined to the intended area to be illuminated, the fixture is not efficient. Inefficient fixtures must use higher wattage light sources to provide the required light needed at the target surface. This can increase the amount of glare if the source is viewable. Even low wattage sources, such as LEDs, can become a potential source of glare if the light source is in the viewer's line of sight. Thus, fixtures that control the light and reduce glare are important for this type of application, and many others.

Another concern with many conventional types of these fixtures is maintenance cost. The operating life of the type of light source or lamp used may not be suitable for the application. Lights that operate for 10-12 hours a day will use around 4000 lamp hours per year. Types of lamps with lower lamp life spans will require replacement more often than sources that operate for long periods. For example, a lamp with 10,000 hour rated life will require replacement every 2.5 years, while a lamp with 50,000 hour rated life may not require replacement for 12.5 years. Less maintenance reduces the overall operating cost of the lighting system. However, many typical light fixtures for the above-described applications use lower rated life span lamps and are adapted for those types of lamps.

Therefore, many opportunities exist for improving the current state of lighting for pathways and similar or analogous areas or applications. It is the intention of this invention to solve or improve over such problems and deficiencies in the art.

II. SUMMARY OF THE INVENTION

According to aspects of the present invention, a lighting system is presented whereby design and selection of optical elements, in combination with design and selection of housing, results in a customized light output suitable for use in bollard-style lighting applications (or other applications) while minimizing undesirable lighting effects common in the state of the art.

It is therefore a principle object, feature, advantage, or aspect of the present invention to improve over the state of the art or address problems, issues, or deficiencies in the art.

Further objects, features, advantages, or aspects of the present invention include an apparatus, method, or system which:

a. is highly efficient;

b. effectively controls and directs light output;

c. controls or reduces glare;

d. reduces maintenance needs;

e. is economical;

f. is durable and robust, even in out-of-doors environments; and/or f. is practical.

These and other objects, features, advantages, or aspects of the present invention will become more apparent with reference to the accompanying specification and claims.

A method according to one aspect of the invention comprises controlling light output in a bollard-type light or a wall mounted fixture for downlighting of an adjacent elongated area to reduce glare and wasted energy.

A method according to another aspect of the present invention comprises controlling the shape of a light output pattern produced by a lighting fixture, as well as the size and direction of the pattern, to provide effective lighting at a target location and reduce wasted light.

A method according to another aspect of the present invention comprises reducing glare from a light source by shielding the source from typical viewers when a lighting fixture containing said light source is installed in operable position.

III. BRIEF SUMMARY OF THE DRAWINGS

Figure 20A:
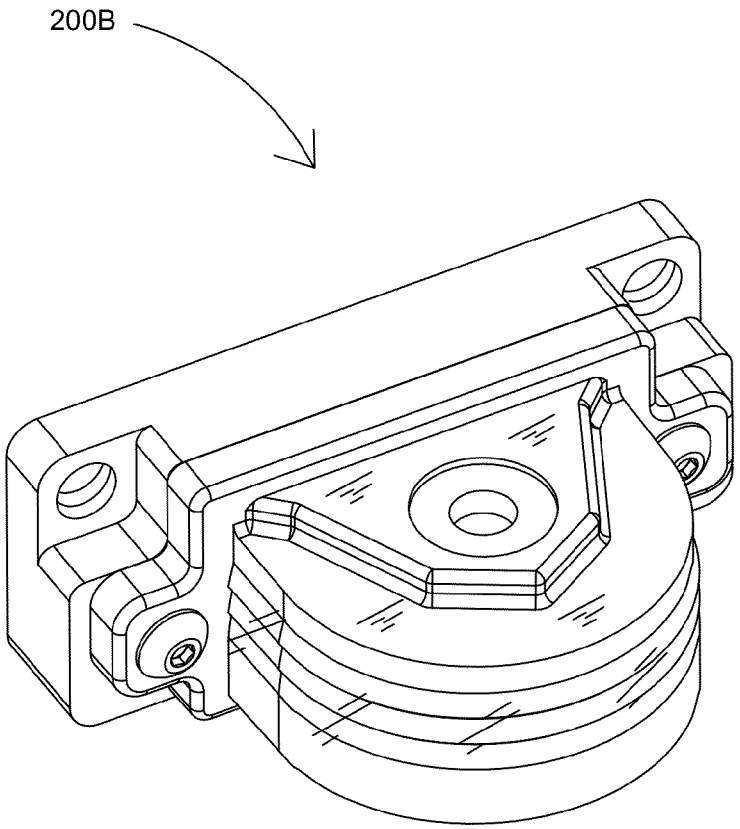
Figure 20B:
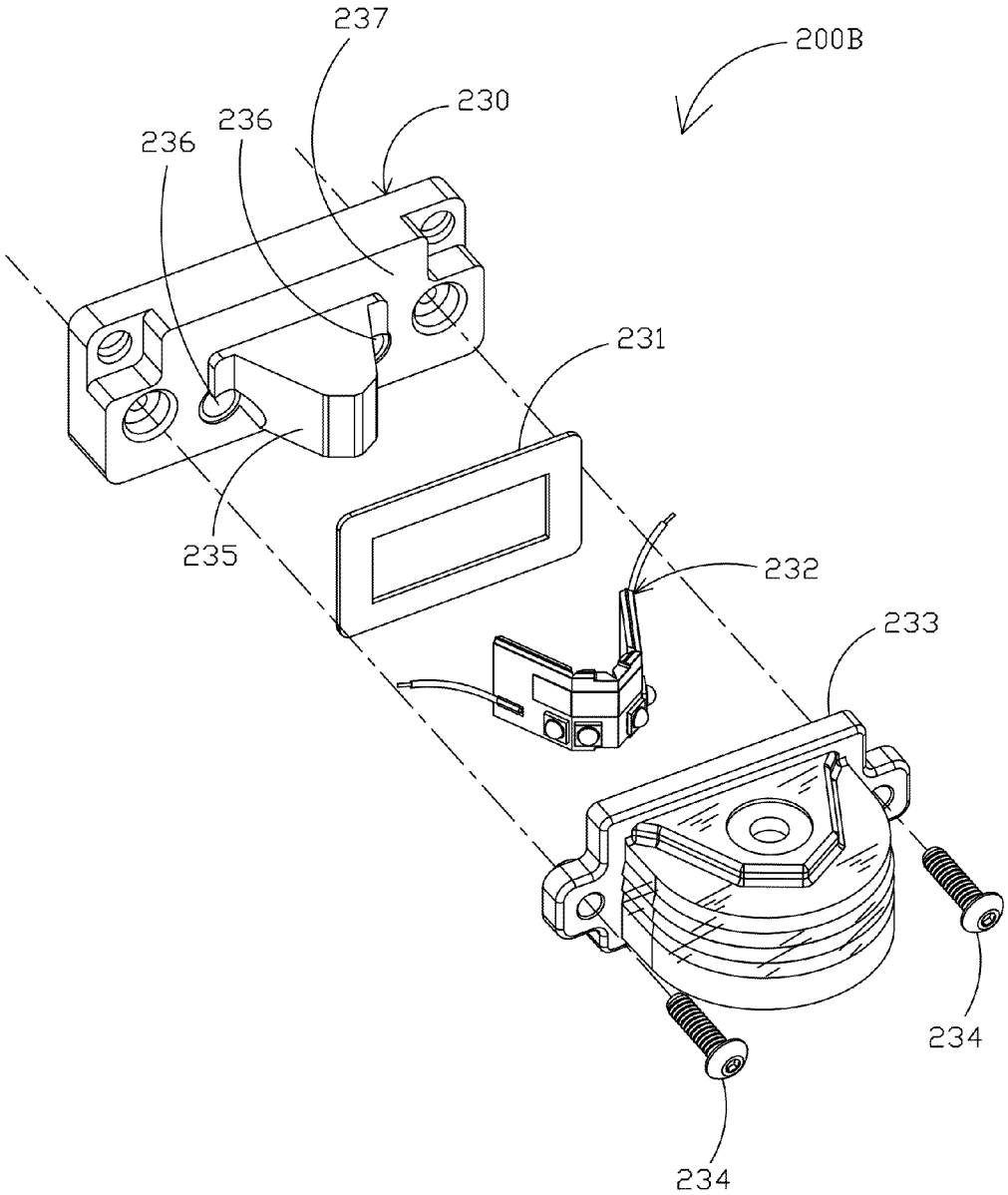

FIGS. 20A and B illustrate in assembled and exploded views, respectively, another embodiment—an LED module—according to aspects of the present invention.

FIGS. 21A-E illustrate various views of the LED assembly of the LED module of FIGS. 20A and B.

Figure 21A:
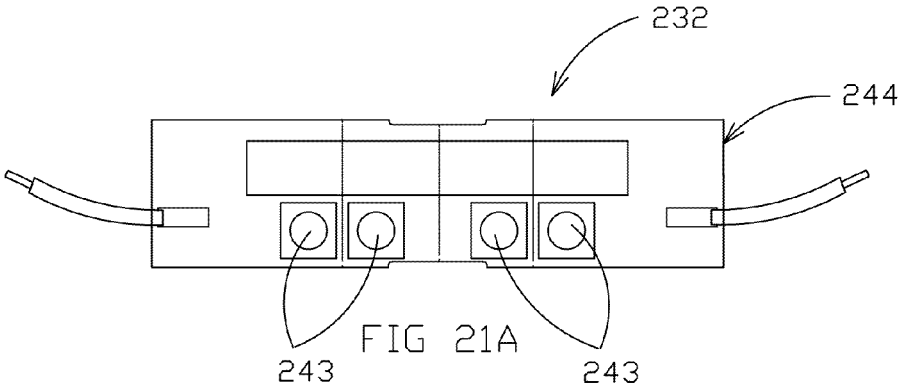
Figure 21B:
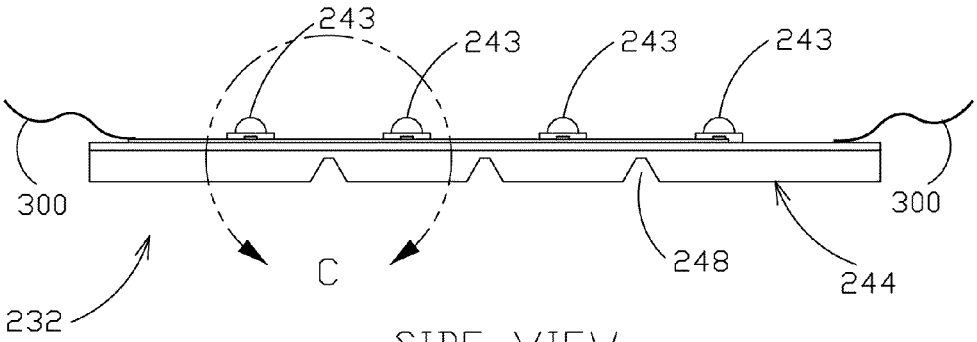
Figure 21C:
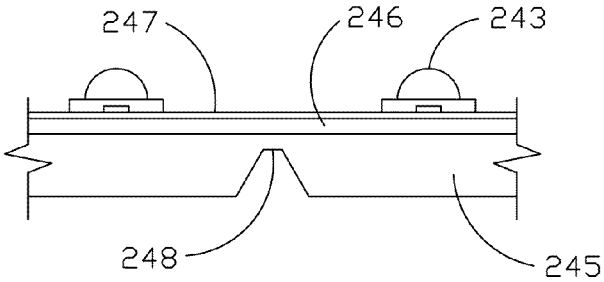
Figure 21D:
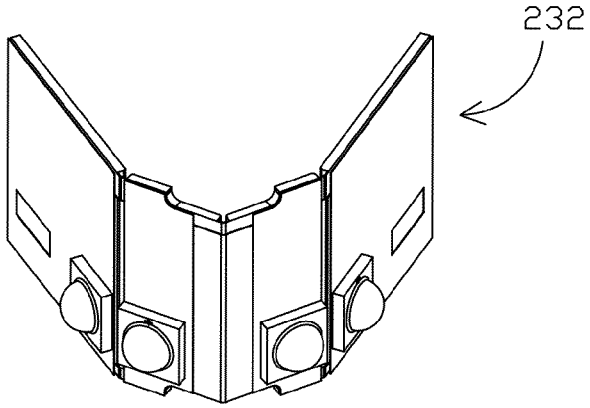
Figure 21E:
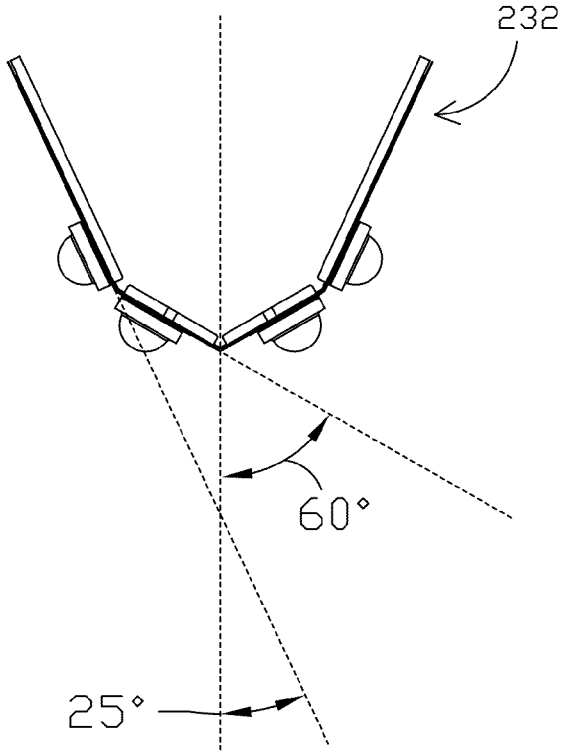
Figure 22A:
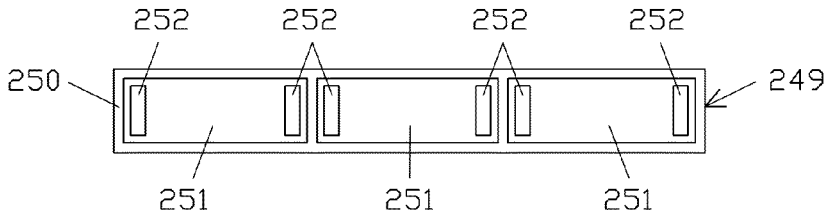
Figure 22B:
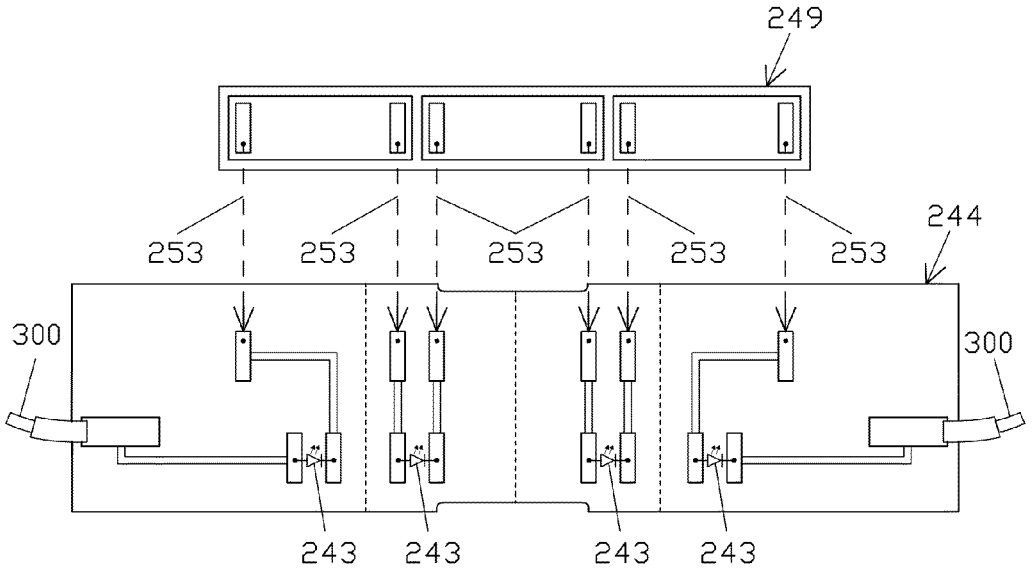
Figure 23A:
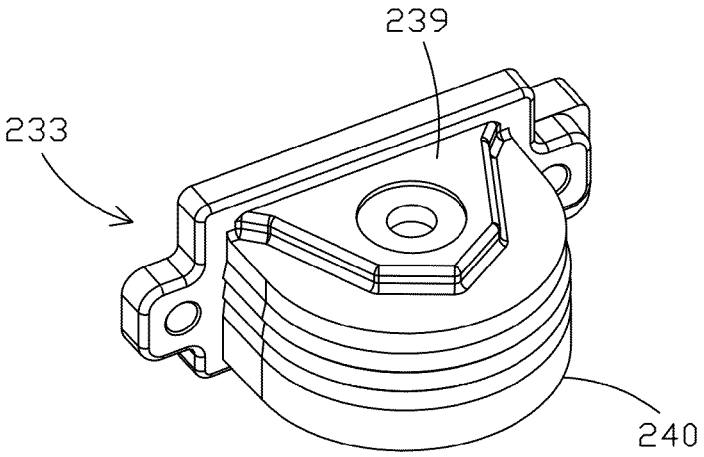
Figure 23B:
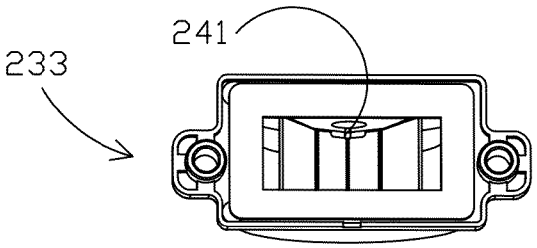
Figure 23C:
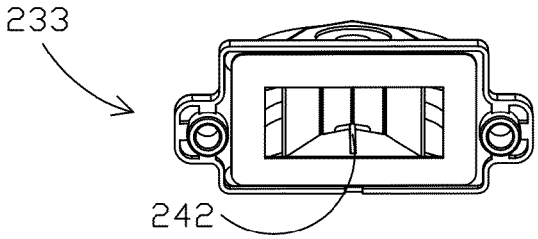
Figure 23D:
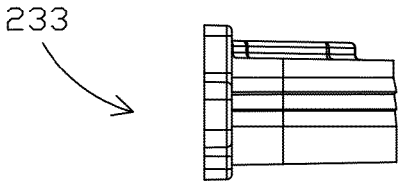

FIGS. 22A and B illustrate an optional flexible printed circuit strip for use with the circuit board of the LED assembly of FIGS. 21A-E.

FIGS. 23A-D illustrate various views of the lens of the LED module of FIGS. 20A and B.

FIGS. 24A-D diagrammatically illustrate one possible lighting pattern when the LED module of FIGS. 20A and B is installed in a first operating position.

FIGS. 25A-D diagrammatically illustrate one possible lighting pattern when the LED module of FIGS. 20A and B is installed in a second operating position.

Figure 24A:
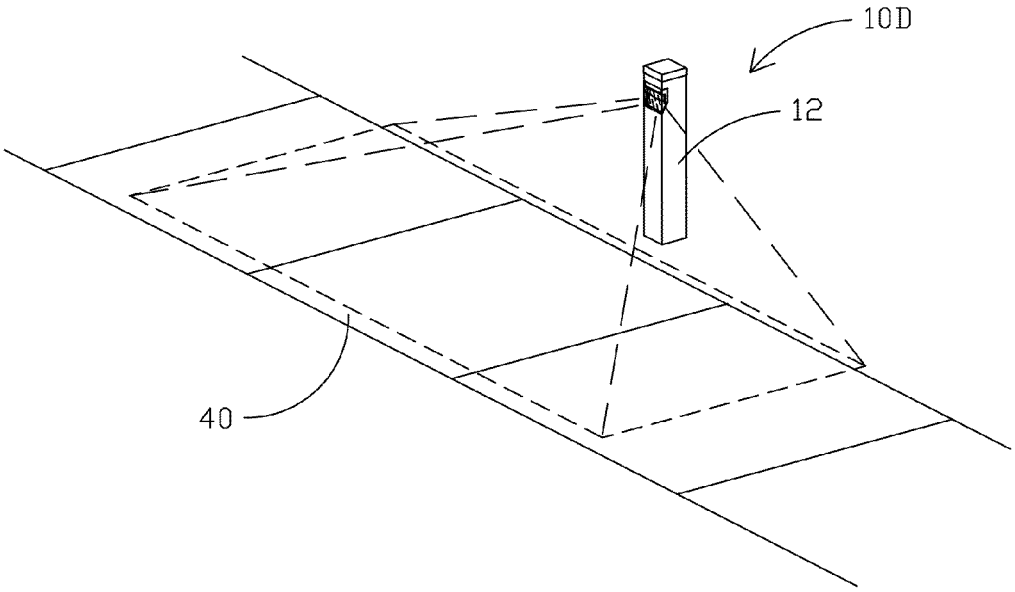
Figure 24B:
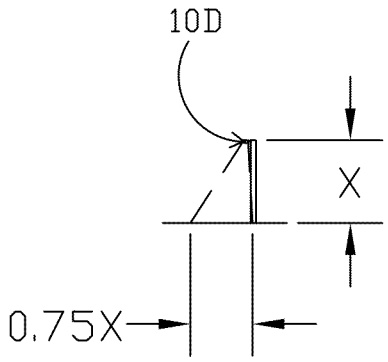
Figure 24C:
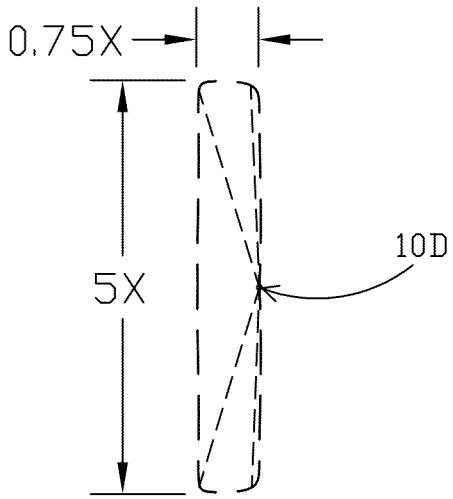
Figure 24D:
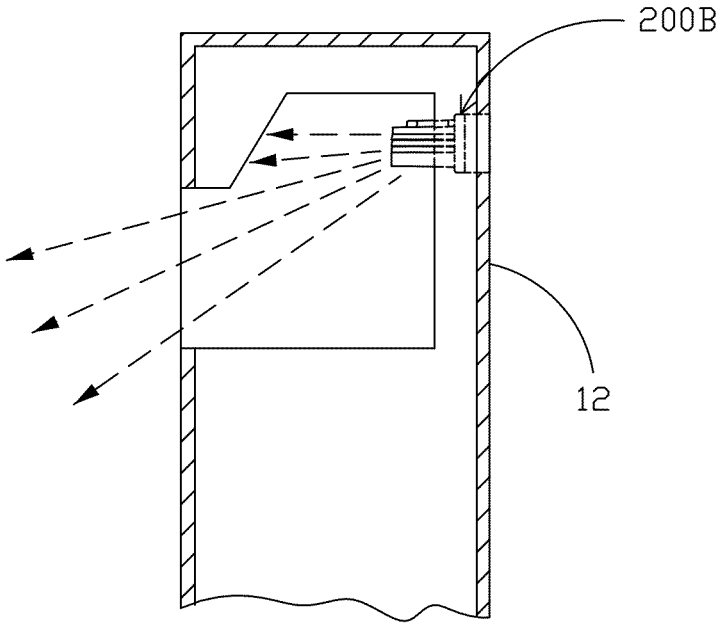
Figure 25A:
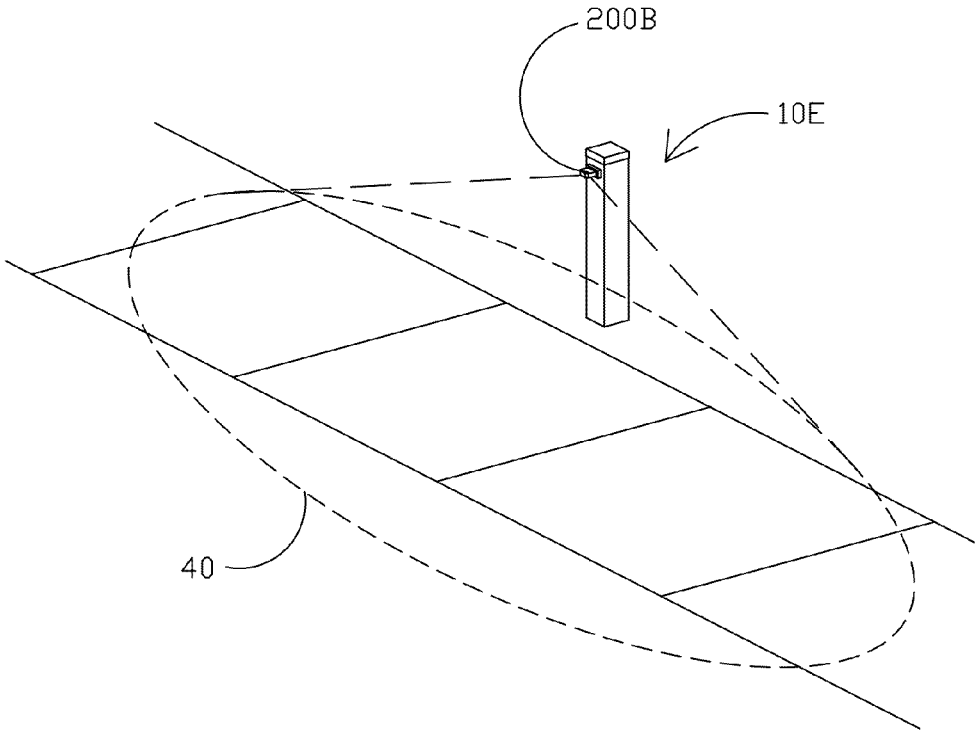
Figure 25B:
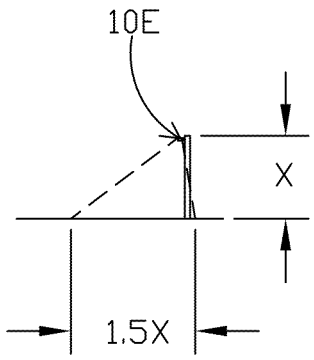
Figure 25C:
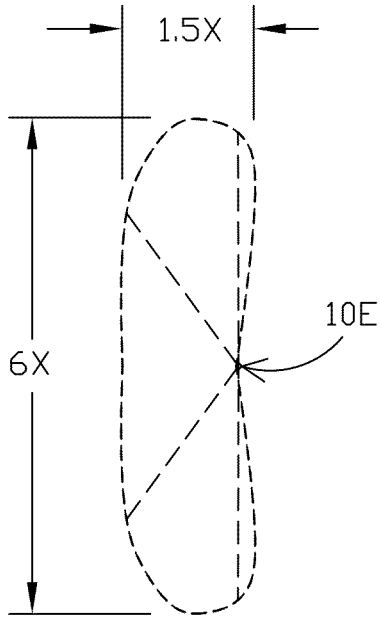
Figure 25D:
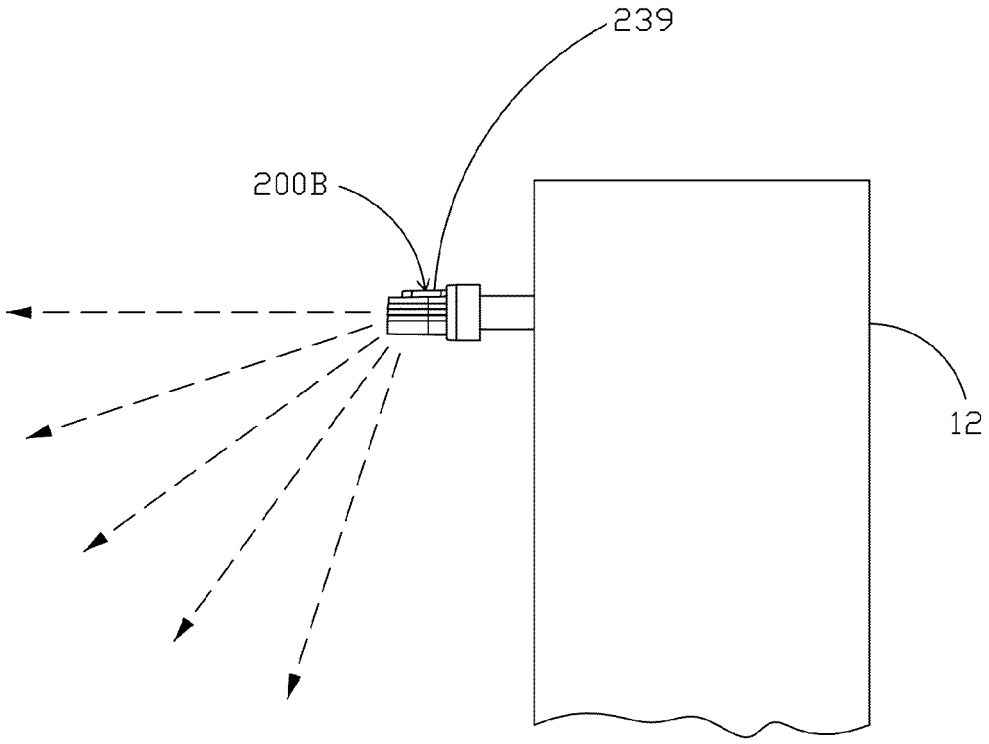
Figure 26A:
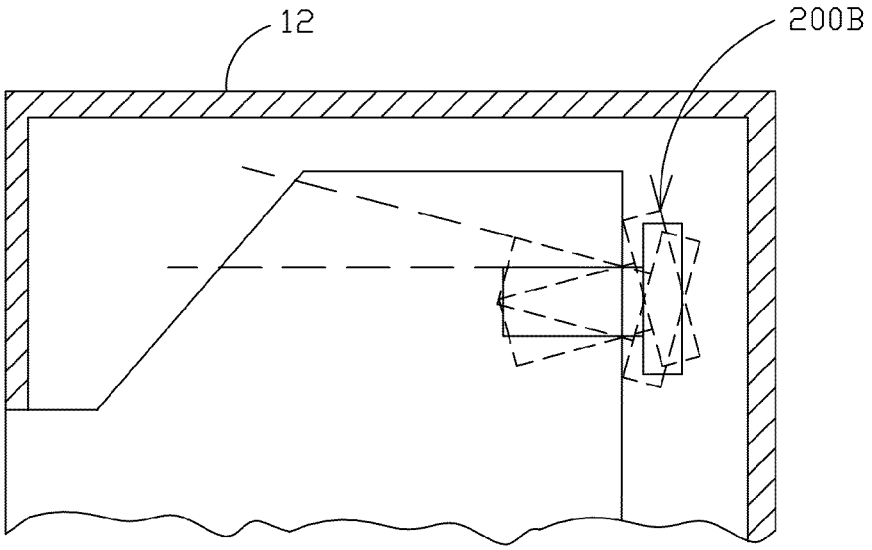
Figure 26B:
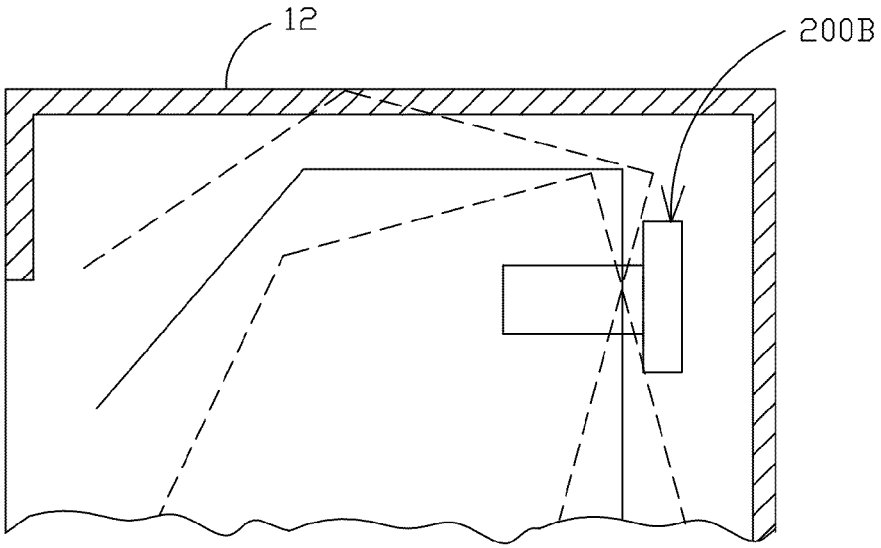
Figure 26C:
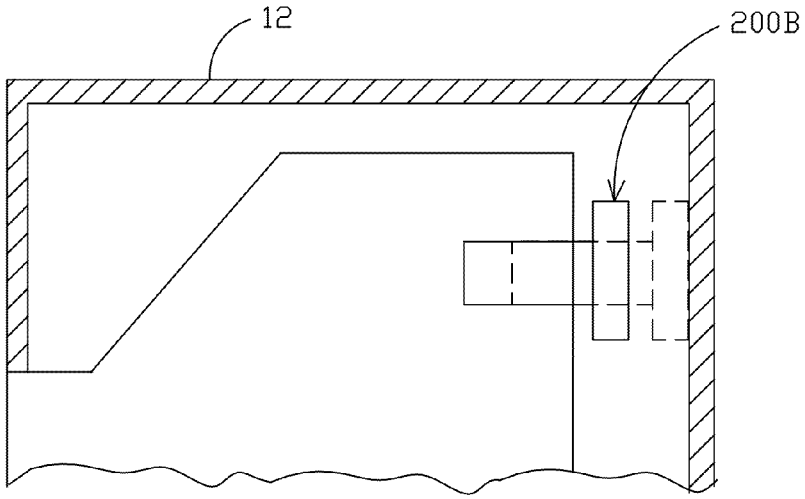
Figure 26D:
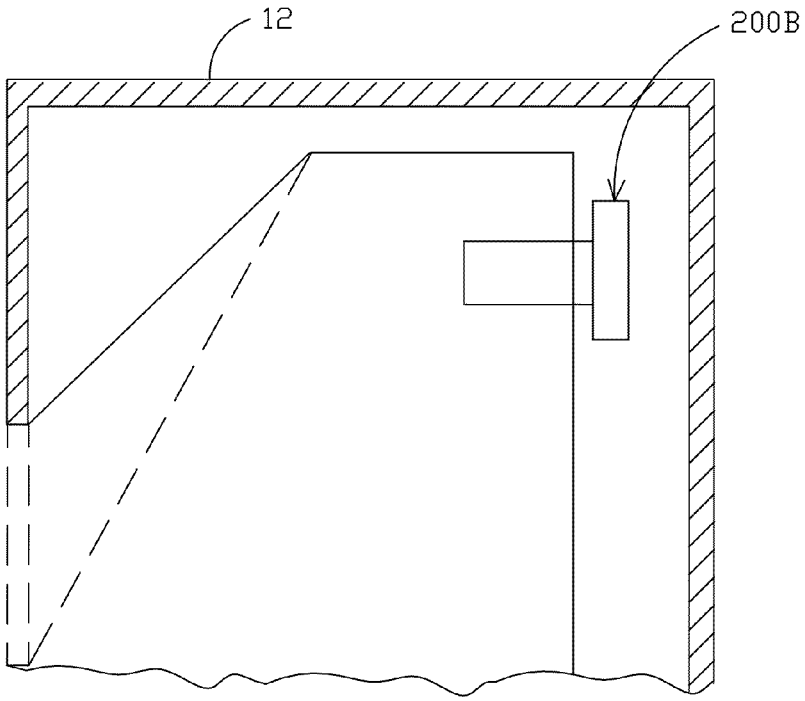

FIGS. 26A-D illustrate a few possible modifications to the first operating position of FIG. 24D so to modify the lighting pattern of FIGS. 24A-D.

IV. DETAILED DESCRIPTION OF EXEMPLARY EMBODIMENTS

A. Overview

To assist in a better understanding of the invention, several examples of forms it can take will now be described in detail. It is to be understood that these are but a few forms the invention could take. A few alternatives and options will also be described. However, the invention could take many forms and embodiments. The scope of the invention is not limited by the few examples given herein. Also, variations and options obvious to those skilled in the art will be included within the scope of the invention.

B. Figures

From time to time in this description, reference will be made to appended figures. Reference numbers or letters will be used to indicate certain parts or locations in the figures. The same reference numbers or letters will indicate the same or similar parts or locations throughout the figures unless otherwise indicated.

C. Conventional Systems

Conventional bollard-type pathway lighting configurations are well-known. For example, a plurality of bollard-type fixtures (a light source at or near top of a post or bollard) are installed throughout a landscape (e.g., a park, an estate), generally aside a pathway. These types of fixtures are generally unshielded, with only the lens to protect the viewer from direct view of the light source. In some cases the lens is translucent or almost opaque to reduce the glare and create a muted light. However, this significantly reduces the light available from the fixture. In addition to illuminating the pathway, the area surrounding the bollard is many times also illuminated. While for some landscaped areas this may be desirable, for many others it is not. Some bollard-type lights have some areas around the light source covered or blocked to give some crude control of light.

Another well-known type of light fixture used for landscaping and pathways is commonly referred to as a pagoda light. These types of lights are mounted much closer to the ground surface than a bollard-type light. However, they are similar in how they perform and have the same concerns as bollard-type lights. One reason they are called pagoda lights is the stacked arrangement of cone-shaped plates or baffles that evoke the general appearance of a pagoda. These plates may block some uplight, but only crudely, and tend to give at least some direct line-of-sight to the light source.

The present embodiments of the invention are used for applications similar to conventional bollard or pagoda type systems, but provide efficient and highly-controlled light output that can be directed to substantially only the target area.

D. Exemplary Method and Apparatus Embodiment 1

According to a first exemplary embodiment of the invention, the method, apparatus and system comprise:

a relatively high efficiency light source;

an optic system to provide the desired beam size and shape;

an electrical circuit to power the light source; and a housing and fixture mounting.

The system produces a long and narrow rectangular beam that is suitable for illuminating a pathway; alternatively, the light beams could be shaped to fit curves in a pathway, intersections of pathways, or other areas of interest.

Figure 1A:
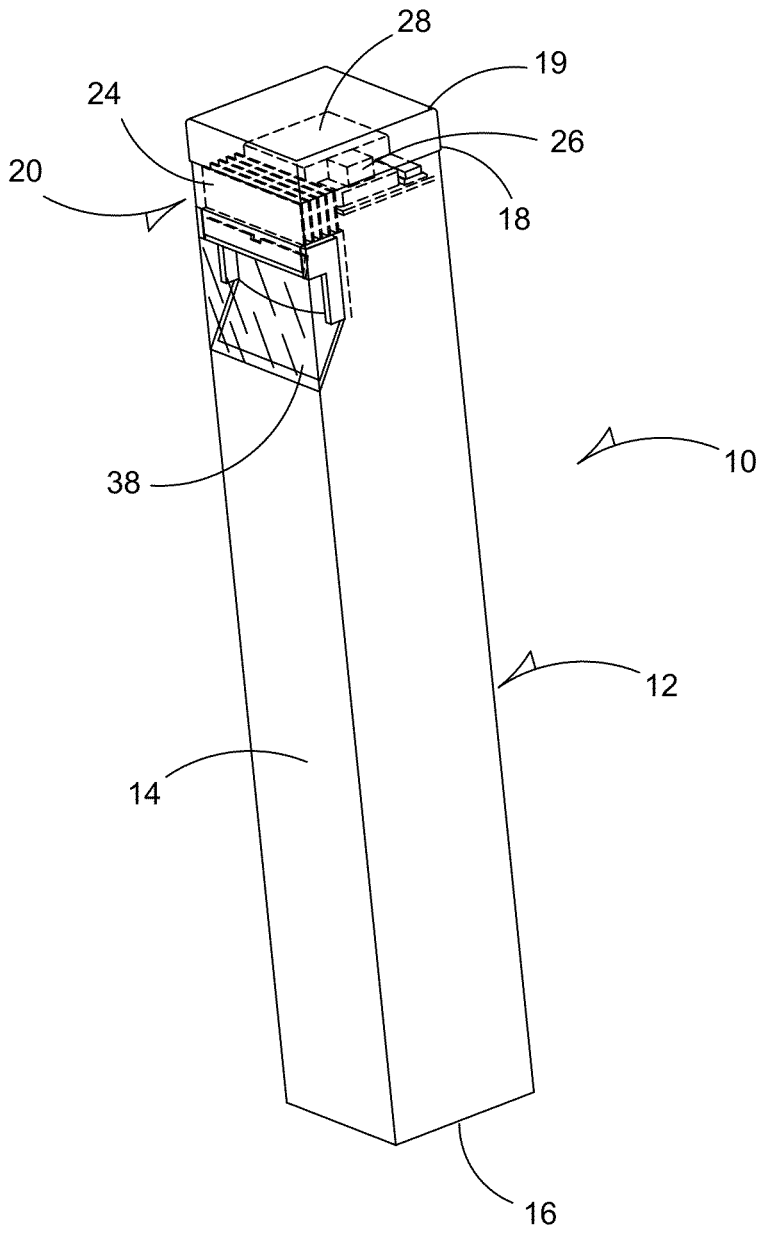
FIG. 1A is a perspective view of an exemplary embodiment according to the present invention.
Figure 1B:
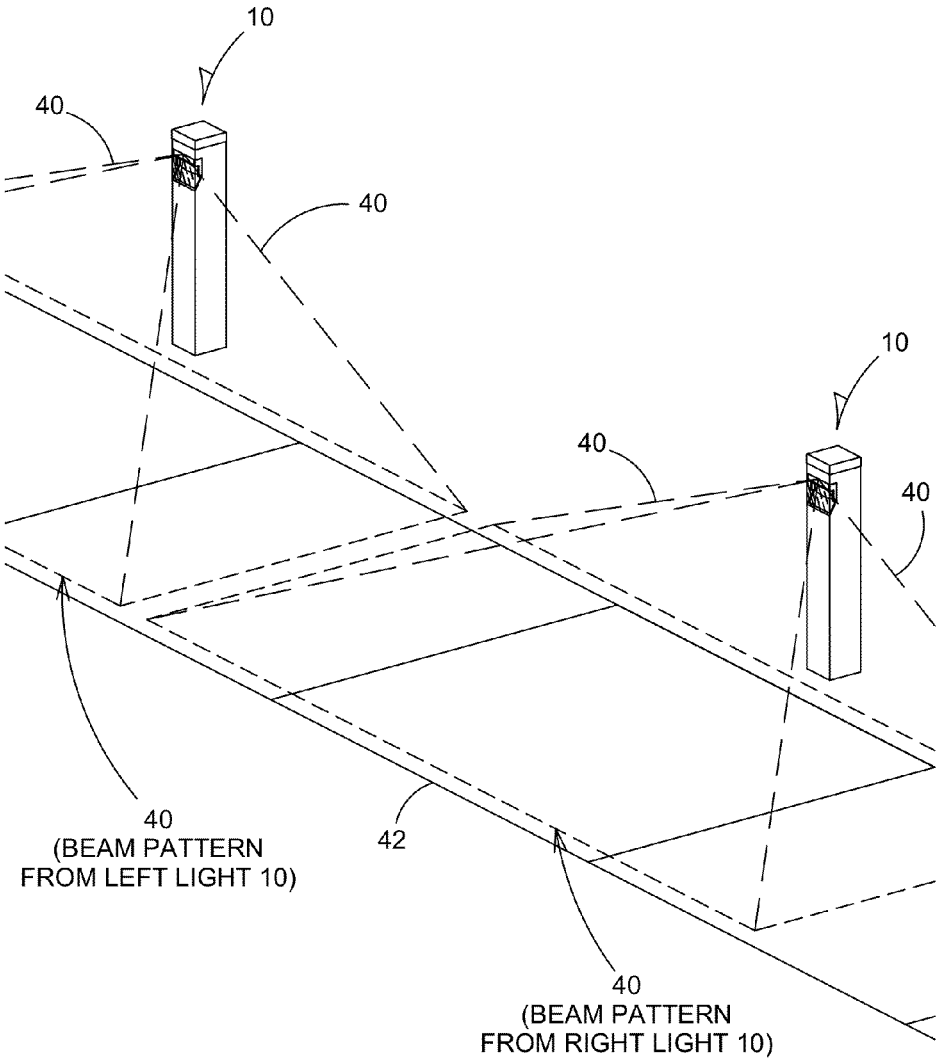
FIG. 1B is a reduced-in-scale perspective diagrammatic view of two pathway lighting devices of FIG. 1A and lighting patterns projected therefrom relative a pathway.
Figure 1C:
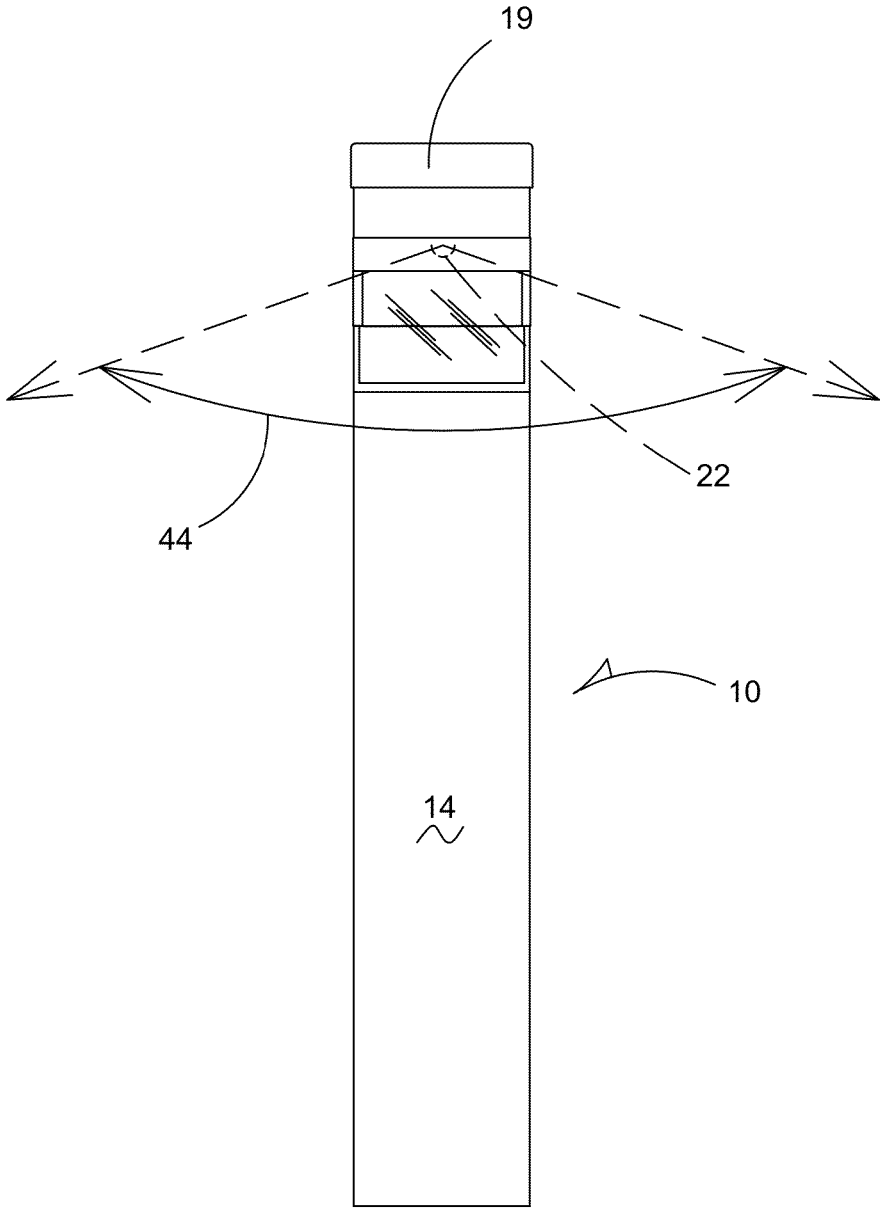
FIG. 1C is a front elevation plan view of FIG. 1A, diagrammatically depicting the light output from the device from that perspective.
Figure 3A:
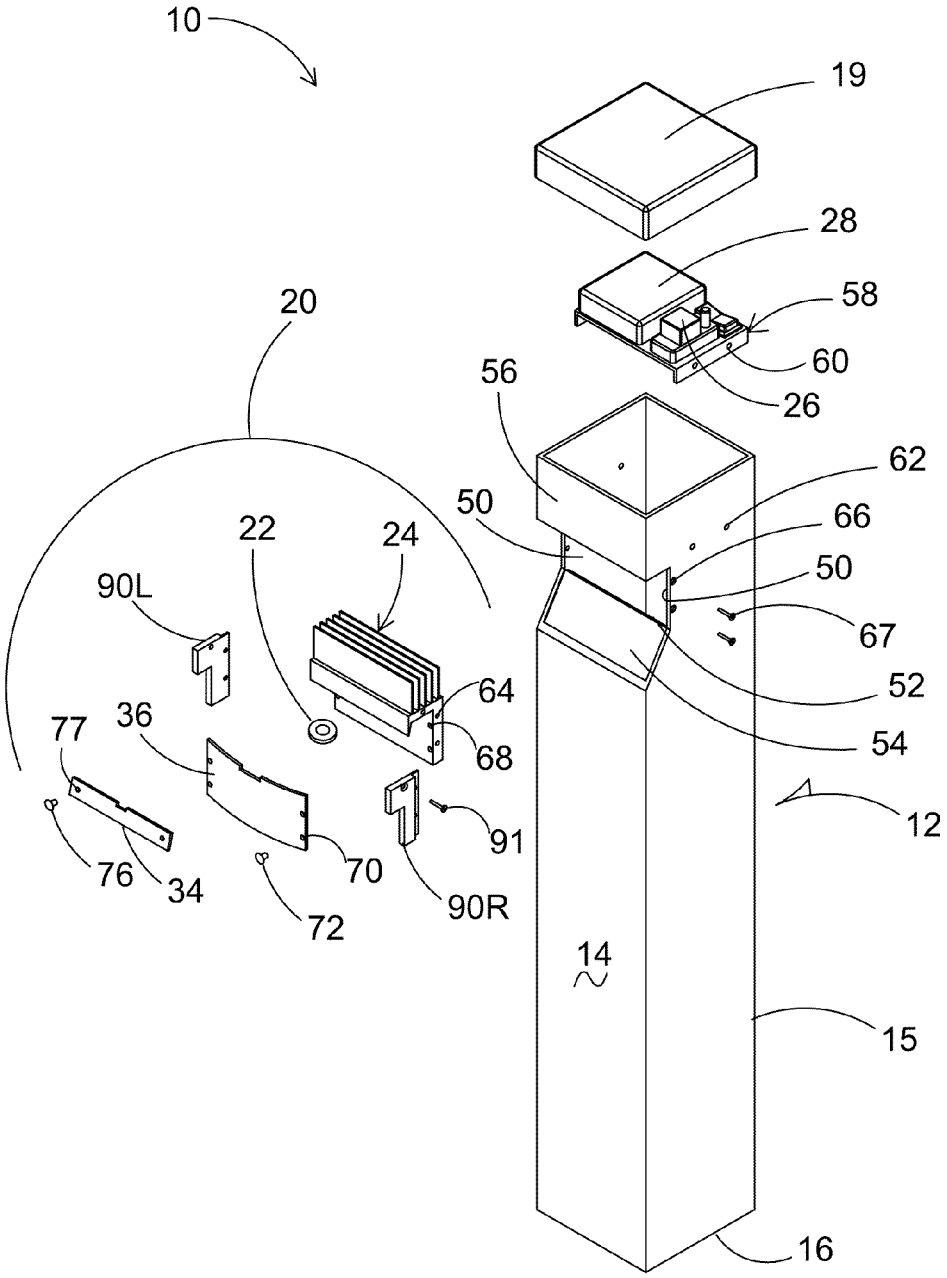
FIG. 3A is an exploded view of FIG. 1A; some components have been removed for clarity.

FIGS. 1A-D, 3A, 4A-B, 5A-C, 6, 7A-D, 8A-B, 9A-B, 10A-B, and 11A-E illustrate an apparatus and method according to Exemplary Embodiment 1 (designated generally by reference number 10). It comprises a rectangular or square-in-cross-section metal tubular post or bollard 12 with recessed opening or cut-out 50 (e.g., FIG. 3A) in the front face and partially in the sides. A commercially-available, solid state light source 22 (FIGS. 1C and 3A), in this case an LED, is mounted to heat sink 24 and is electrically connected to an electrical circuit board assembly 58 (FIG. 3A). The circuit board assembly 58 is mounted inside post 12. The tubular post 12 serves as the housing for the light source 22 and its electrical system.

Light source 22 utilized in this embodiment is highly efficient, i.e., has a high lumens per watt ratio, yet is very compact. Such high output LED light sources are an excellent choice due to lumen per watt output in the range of 60 lumens or greater per watt of energy consumed. One example of such an LED is a LUXEON® Emitter model LXHL-DW01 available commercially from Philips Lumileds Light Company, San Jose, Calif. (USA). Details can be found at Technical Data Sheet DS25 (March 2006), available from Philips Lumileds Lighting Company, and incorporated by reference herein. Other LEDs, or even other light sources, may also be used.

The most common color of light output for this application is white; however, other colors are possible and are considered to be included as possibilities. The type of LED used in this embodiment has a side-emitting light output. This type of output helps to provide the long rectangular beam without creating a bright spot directly in front of the fixture. The optic design of fixture 10 utilizes this side-emitting characteristic of the LED to provide the desired shape of the beam without bright spots that create an uneven appearance. A representative spatial radiation pattern for such a side-emitting LED is set forth at Technical Data Sheet DS25, top of page 16. Most of the intensity of the light radiates laterally from the lens of the LED. In this embodiment, LED 22 is mounted lens-down and generally vertically (see FIG. 11C). Therefore, most of the light from the side-emitting model of LED 22 radiates radially outwardly in a generally horizontal plane. As indicated in the radiation pattern of FIG. 11C, the light spreads some, but radiates substantially radially or laterally outwardly in all directions. See also U.S. Pat. No. 6,679,621 incorporated by reference herein, which gives a general illustration at FIGS. 13 and 14 of a side-emitter LED radiation pattern (through a vertical cross-section of the LED and its lens).

In Exemplary Embodiment 1, source 22 is side-emitting. It is to be understood that other source types could be used; see, for example Exemplary Embodiment 5. Further, not only side-emitting patterns, but also what are known in the art as "bat wing" and Lambertian patterns could be used (whether a result of a specialized source type or a combination of lens and more standardized source type). If a Lambertian pattern is used, the high concentration of light near the center would cause more light to be present near the fixture and less light at the outer edge of the beam. Graphs of the bat-wing and Lambertian patterns can be seen at www.lumileds.com/technology/radiationpatterns.cfm, incorporated by reference herein.

The optic system 20 (FIG. 3A) of the present embodiment captures incident light from source 22 and directs it to the target area (e.g., pathway or sidewalk 42 (FIG. 1B) to be illuminated). For pathway lighting, a relatively long and narrow light beam is beneficial to reduce the amount of wasted light that spills off the intended area. This wasted light often illuminates unwanted area and distracts from the main areas of interest. In other words, it is generally desirable that the beam follow the general shape of the pathway.

Optic system 20 uses some surfaces of highly reflective material to direct some of the light from the fixture 10. The optics 20 control the light in the forward direction, prevent light from traveling in the reverse direction, i.e., behind post 12, and project light laterally out the sides to create a beam that is longer laterally (in opposite directions from and parallel to the front of bollard 12) than its width (straight out from the front of the bollard 12). To project the light to opposite sides, a curved reflective surface 36 (FIG. 3A) is used to direct the light in the intended direction. By referring to the Figures, it can be seen how the relatively compact light source 22 output pattern can be spread laterally in opposite directions in front of the bollard primarily by curved reflective surface 36. For example, the lateral horizontal beam spread 44 is controlled (see FIG. 1C), as well as vertical beam spread 46 (see FIG. 1D).

It is to be understood that selection of the particular shape and reflective characteristics of surface 36 can vary according to need and desire. The beam can be made longer, shorter, wider, or thinner. Alternative reflective material can be used to alter the beam size and shape. For example, a semi-specular material or peened pattern can be used to create a wider beam as these types of materials tend to diffuse the light. The shape of the beam can be altered by changing the position of the reflective material. More on these alternates will be discussed later. The precise shape and nature of the output light pattern from fixture 10 can be varied according to need or desire by empirical methods and the skill of those skilled in the art.

As shown in the Figures, and as diagrammatically illustrated in FIGS. 11A-E, the light source 22 and optics 20 are defined substantially by a box-shape surrounding light source 22. The box shape has an open bottom. The convex curved surface 36 forms the back wall of the box-shape and extends substantially lower than the light source 22. This accomplishes several things. One is that the light source 22 is basically hidden from direct view by normal viewing angles. This reduces glare into the eyes of viewers or passersby. Another is that the box or enclosure blocks much light that otherwise might tend to travel outside the intended controlled pattern. Another is that the limited radiation pattern of the side-emitter LED 22 is substantially contained in the box, but the placement and selection of certain highly reflective surfaces inside the box intercept and redirect much of the light onto convex surface 36, or intercepts and redirects light directly from source 22, which tends to evenly spread the light in the rectangular pattern that not only lights the area directly in front of the bollard 12, but substantially in opposite lateral directions. In this manner, light is controlled to place most of it only on the pathway, but also have a somewhat even illumination for a substantial distance both left and right of fixture 10 (see FIG. 1B). It is emphasized that the light output pattern does not have a point of very high intensity or "hot spot", but is more evenly distributed. This allows relatively wide spacing of the next light fixture 10 and so on. Fewer lights 10 are needed to light the whole pathway. Additionally, less light is wasted by spilling off the target, the pathway, which is a more efficient use of light. Also, less spill light means there is higher contrast between the lighted path 42 and the non-lighted areas outside path 42. In at least some circumstances, this greater contrast allows less light to be used to light path 42, which would create even more efficiency. At a minimum, fixture(s) 10 are more efficient individually, but also cumulatively, because they better control light substantially to only the path 42.

Figure 5A:
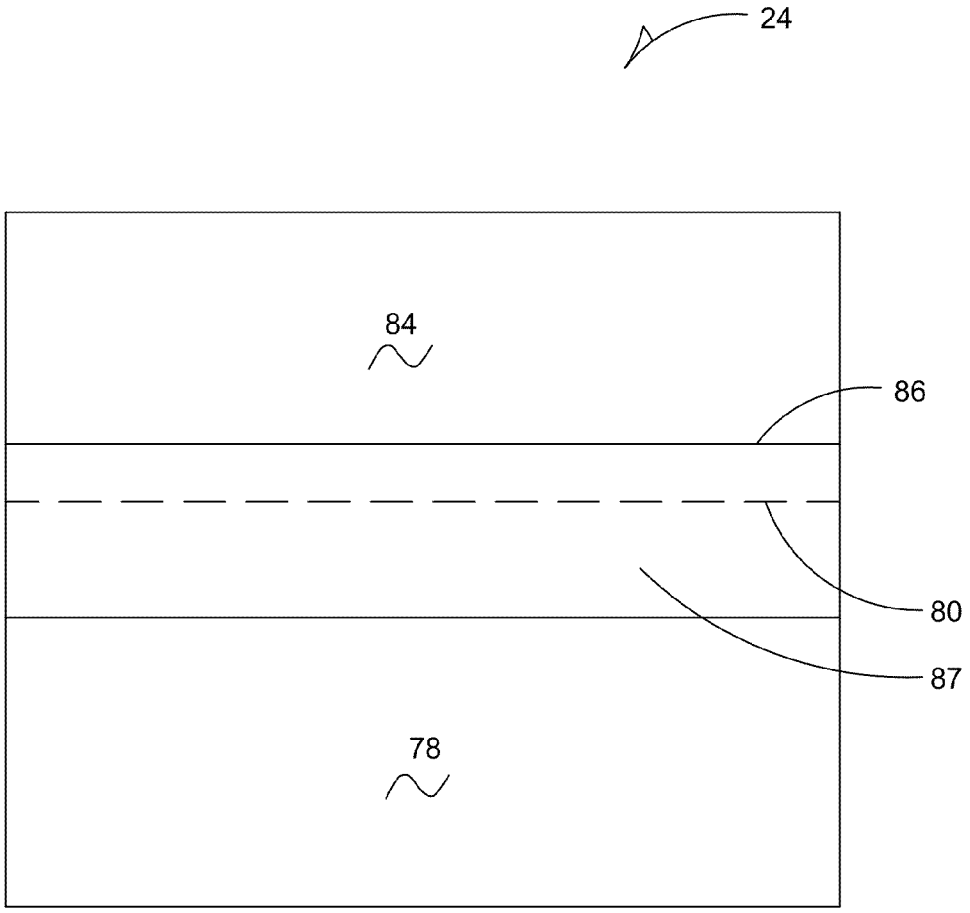
FIG. 5A is an enlarged front elevation plan view of an interior mounting member and heat sink from FIG. 3A.
Figure 5B:
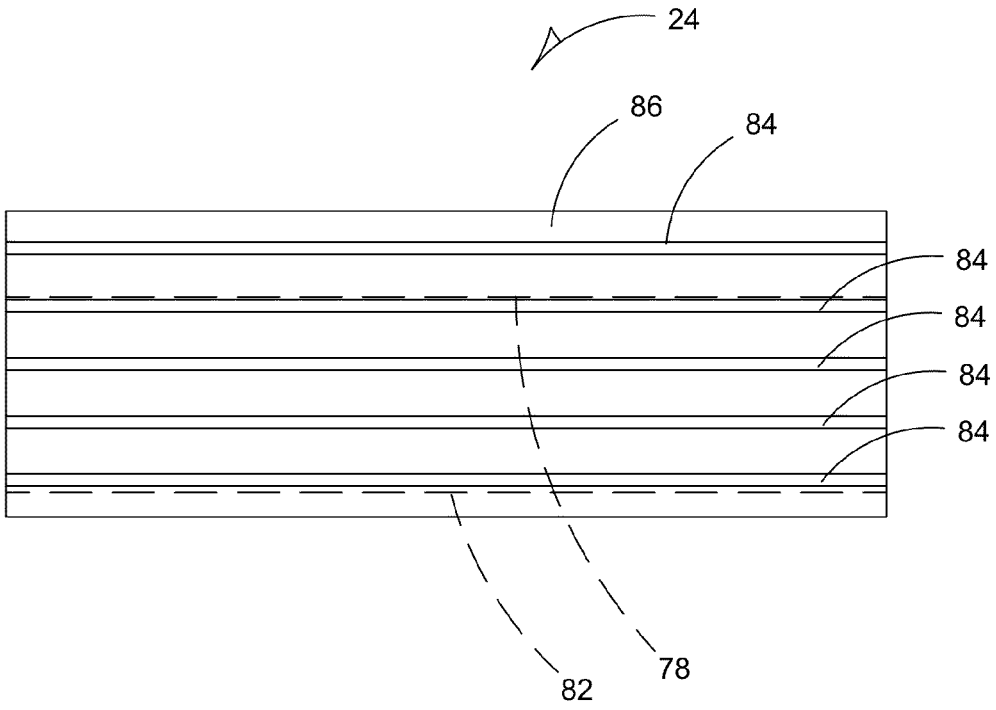
FIG. 5B is a top plan view of FIG. 5A.
Figure 5C:
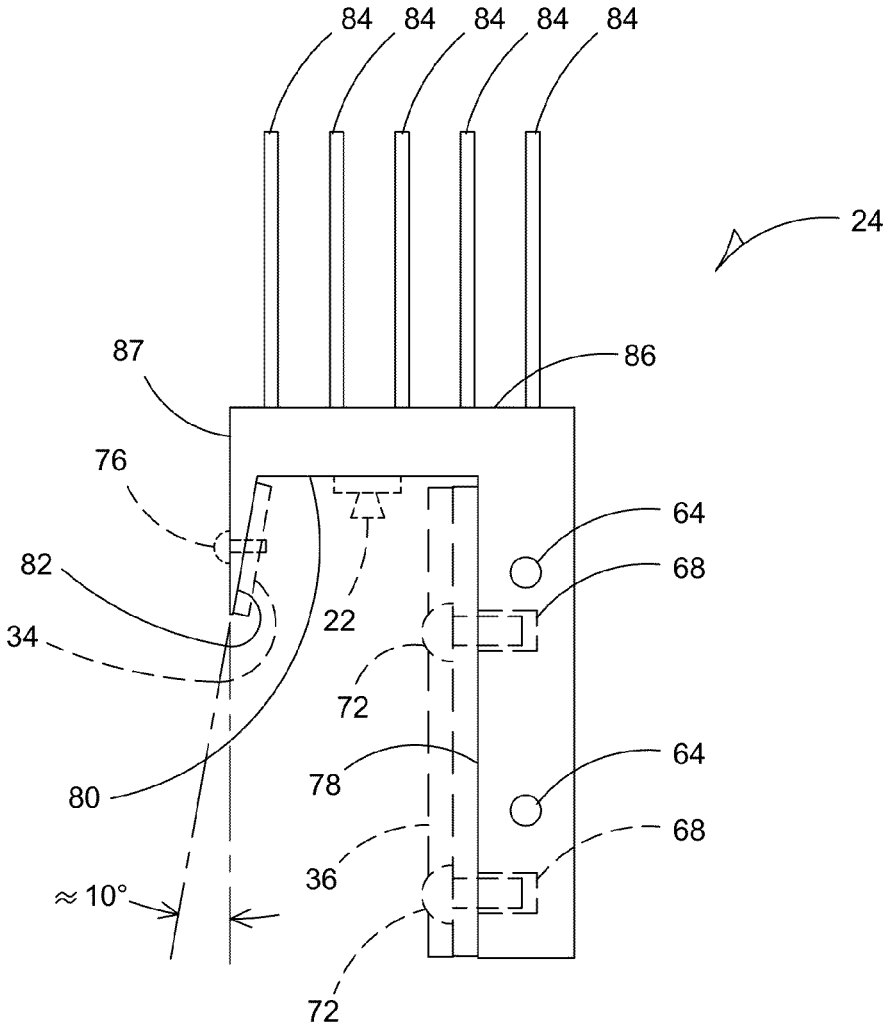
FIG. 5C is a side elevation view of FIG. 5A with internal components shown in broken lines.
Figure 6:
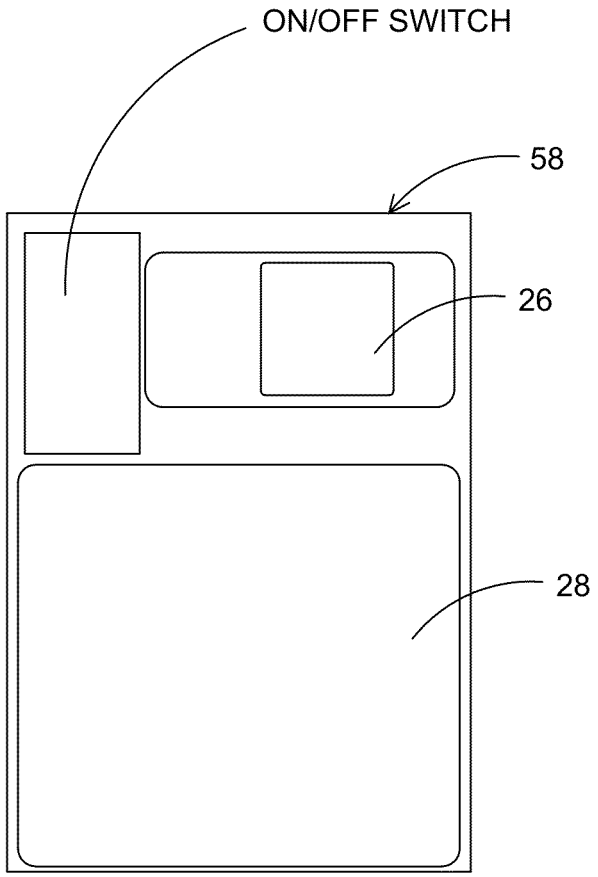
FIG. 6 is a top plan view of a circuit board and components from FIG. 3A.
Figure 7B:
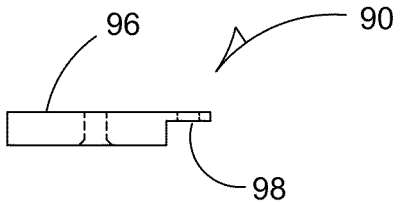
FIGS. 7A and 7B are side elevation and top plan views, respectively, of a side light controlling piece from FIG. 3A.
Figure 7A:
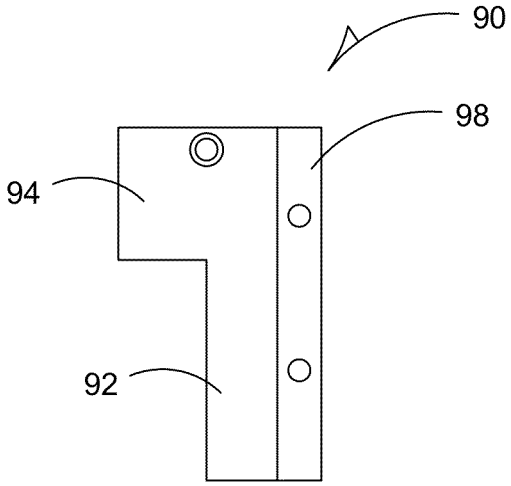
Figure 7D:
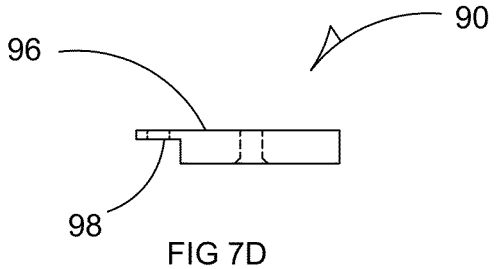
FIGS. 7C and 7D are side elevation and top plan views, respectively, of the opposite side light controlling member of FIG. 3A.
Figure 7C:
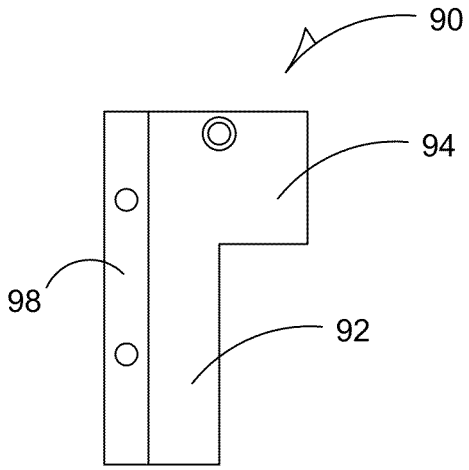
Figure 8B:
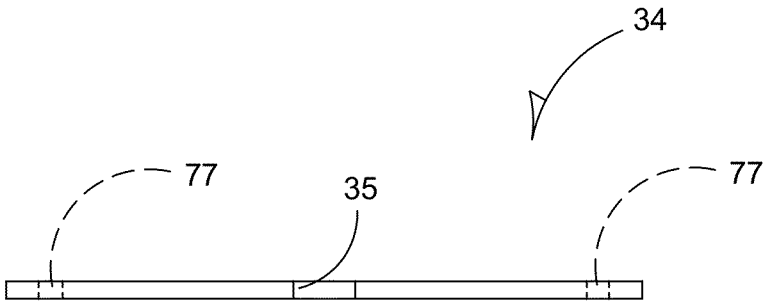
FIGS. 8A and 8B are front elevation and top plan views, respectively, of a reflective member from FIG. 3A.
Figure 8A:
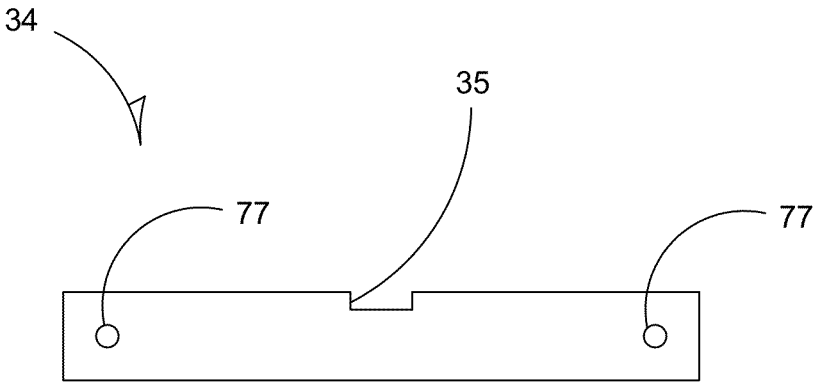
Figure 9B:
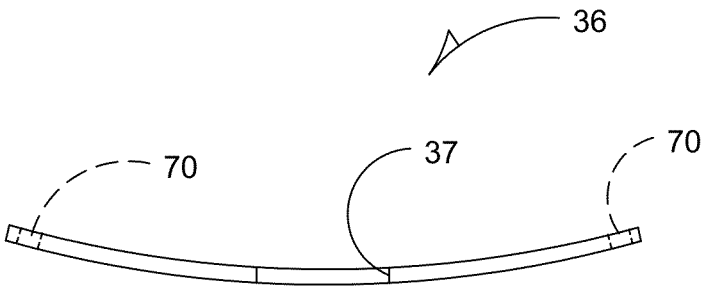
FIGS. 9A and 9B are front elevation and top plan views, respectively, of a second reflective member from FIG. 3A.
Figure 9A:
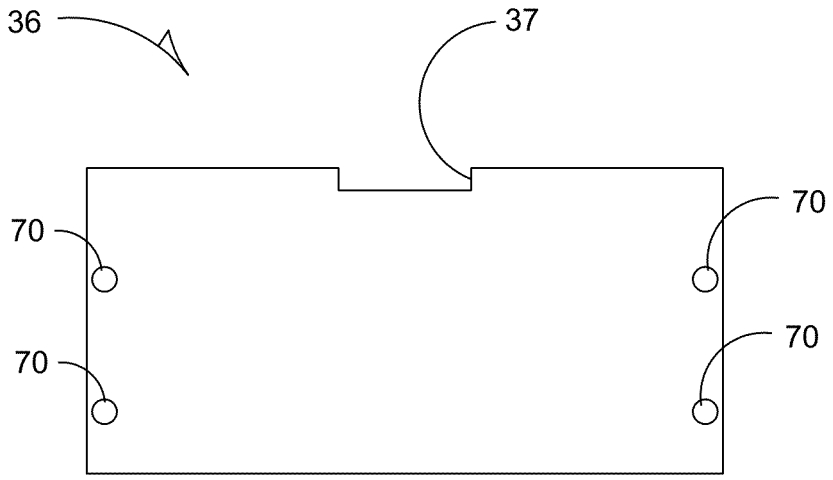
Figure 10A:
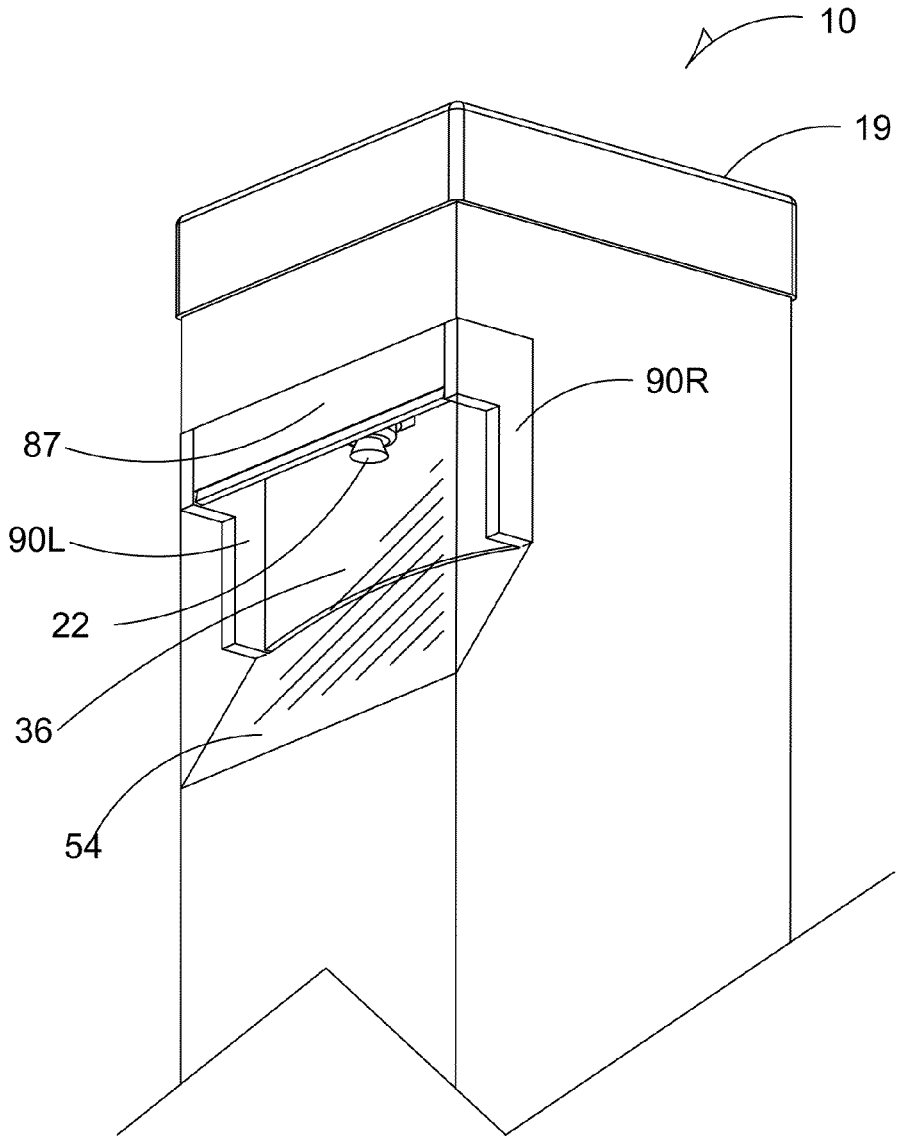
FIG. 10A is an enlarged detailed view of the device of FIG. 1A.
Figure 10B:
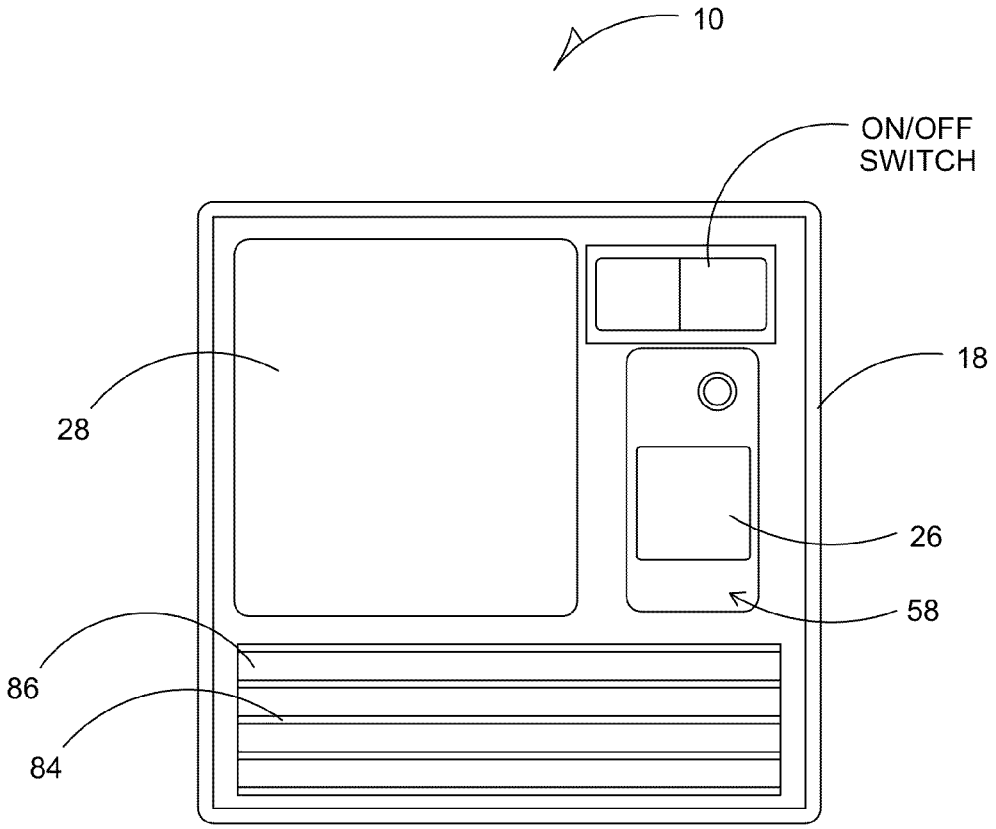
FIG. 10B is an enlarged top plan view of fixture 10 with cap 19 removed.
Figure 11A:
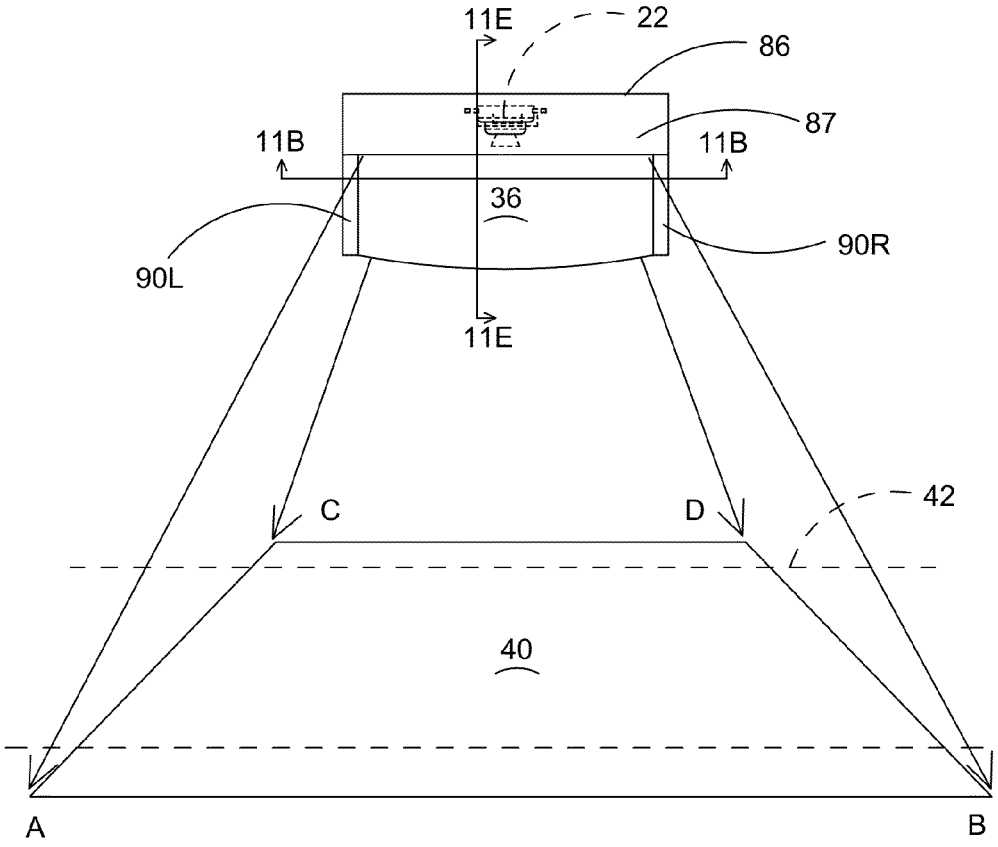
FIG. 11A is an isolated diagrammatic view of the light output pattern from the device of FIG. 1A.
Figure 11B:
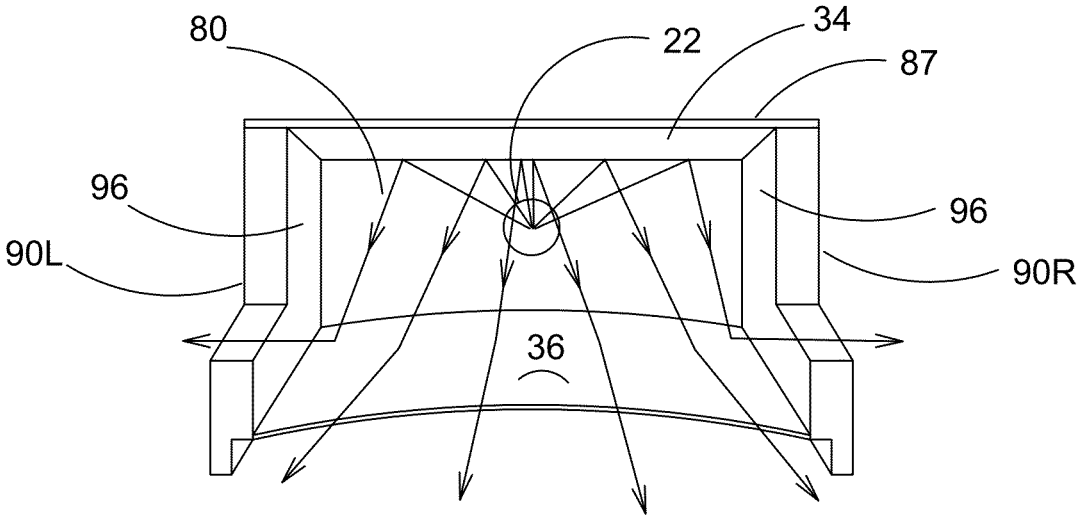
FIG. 11B is an enlarged diagrammatic view of FIG. 11A along line 11B-11B and illustrating a different perspective of the light output pattern of FIG. 11A.
Figure 11C:
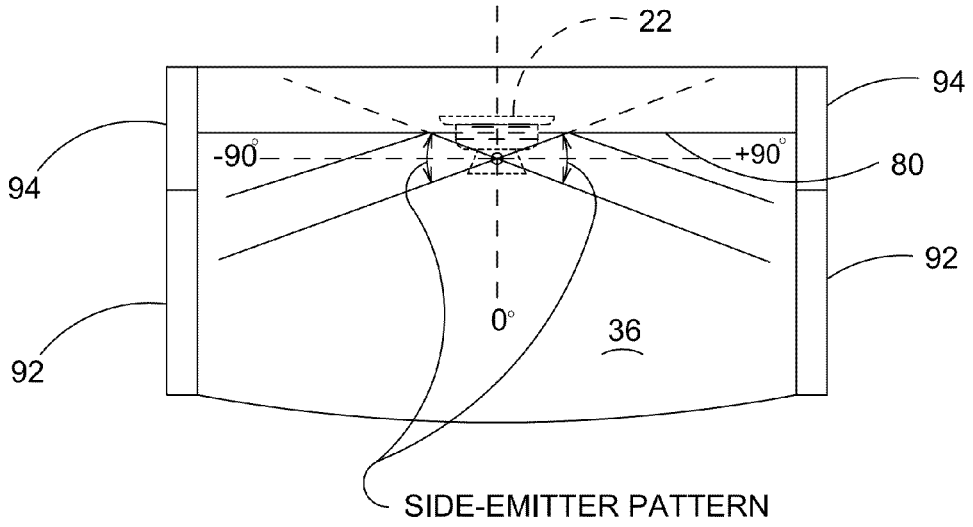
FIG. 11C is a partial sectional and diagrammatic view from a different perspective of the light output pattern of FIG. 11A.
Figure 11D:
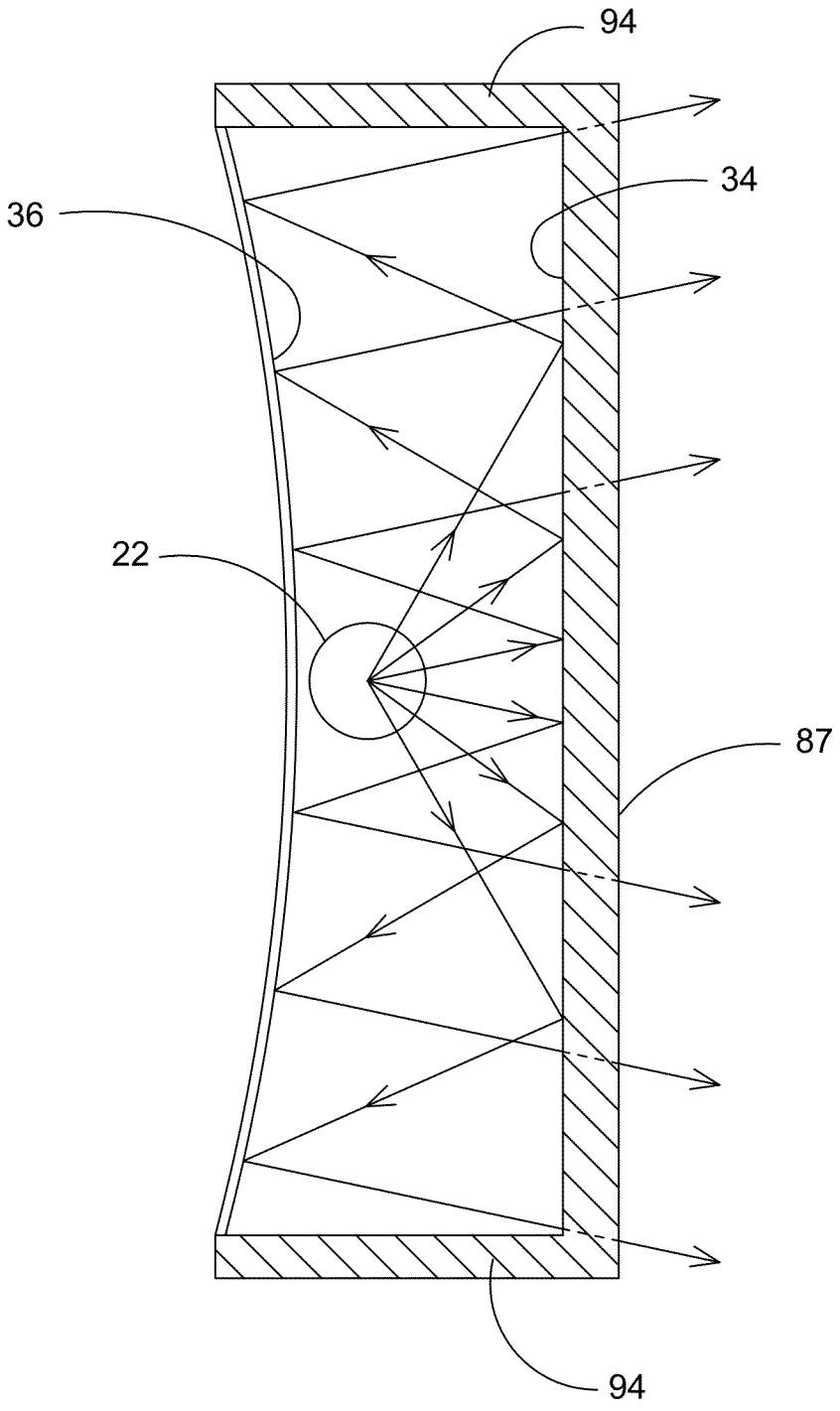
FIG. 11D is a sectional view of FIG. 11E along line 11D-11D and illustrating a different perspective of the light output pattern of FIG. 11A.
Figure 11E:
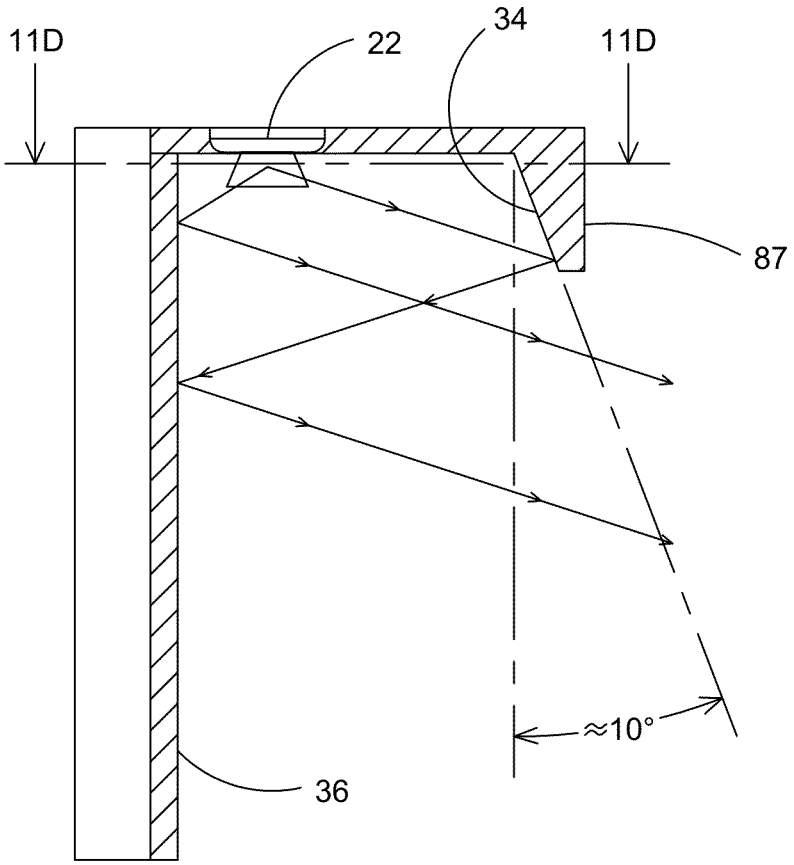
FIG. 11E is a partial sectional view of the light output pattern of FIG. 11A along line 11E-11E.

As can be seen, the optics 20 are basically installed on or integrated with, the heat sink 24 (see, e.g., FIGS. 3A and 5C). This optical sub-housing 24 provides the thermal management method required for the LED light source as well as mounting geometry for source 22 and surfaces 34 and 36. Considerations for thermal management of LED sources is set forth in Application Brief AB05, entitled "Thermal Design Using Luxeon® Power Light Sources" (June 2006) available from Philips Lumileds Lighting Company and incorporated by reference herein. In the present embodiment, the heat sink is essentially sub-housing 24, which also provides the mount for the LED 22. There is no requirement to have the reflecting surfaces on the heat sink, but this is a convenient way of mounting the reflective surfaces relatively close around the light source.

To power the light source, an electrical system is required. The electrical system includes DC power with a constant current driver to provide the required power to the LED. Document COM-DRV-3021-00, (July 2005), rev. 2.3, available from Lux Drive, a division of LEDynamics, Inc. of Randolph, Vt. (USA), entitled "3021/3023 Buck Puck Wide Range LED Power Module", which is incorporated by reference herein, gives details regarding an example of such driving circuitry (e.g., LUXDRIVE™ LED power module model 3021/3023 BuckPuck™ from LuxDrive). The electrical system can include a dimmer to vary the light output, include sensors to detect when light may be required, be remotely controlled by control system, or even be networked together to provide control for an entire region of lights. The DC power source can be from a central DC source, provided from battery power, solar power, or converted from AC to DC at each location.

The post or bollard 12 can be constructed of different materials with a protective finish. The present embodiment utilizes extruded aluminum tubing with a durable powder-coated finish (in any of a number of varying colors). Painted steel, galvanized steel, or stainless steel materials could also be used. Other types of posts can also be used. The tubular post can be square, rectangular or circular, or other shapes. Cast metal can be used to create a decorative post with ornate details. To secure the post 12, a mounting plate (not shown) can be attached (e.g., welded or by other means or methods) to the bottom of the post 12. The post 12, with base or mounting plate, can be anchored to a concrete foundation or to a pathway. Alternately, post 12 can be extended and have its lower end 16 buried into the earth. Other mounting methods are, of course, possible.

1. Details of Embodiment 1

FIGS. 1A-D illustrate the basic embodiment one utilizing a tubular post 12 with an LED light source 22 to produce light suitable for illuminating a pathway 42. The tubular post 12 serves as the mounting and protective housing for light source 22 and its related systems (optic system 20 and electrical circuit assembly 58—see FIG. 3A). Transparent lens cover 38 protects LED 22 and optics 20 from damage and exposure to dirt which can decrease efficiency. Each component will now be discussed in greater detail.

Post 12 here is approximately 4 inches by 4 inches in cross section and 24-36 inches tall. Tubular post 12 is constructed of corrosion resistant, extruded aluminum with protective powder coat finish available with a color or colors to suit the installed environment. Notch 50 (FIG. 3A) near the open top 18 of post 12 is cut into face 14 and sides of tubular post 12 for the light 22 and optical system 20 mounting (see bottom edge of section 56, and exposed sides in FIG. 3A). A sealed cover 19 is installed over the top of the tubular post to keep electrical components dry. Post cover 19 can be constructed of many different materials, including but not limited to composites, cast metals, and a formed plate. This removable arrangement allows easy access to the electrical circuit and optic system from the top of apparatus 10. O-rings, gaskets or other sealing methods (not shown) can be used to help form a seal between post and cover. An alternative embodiment of post 12 may not have a separate cap 19, but have a closed top end.

Figure 1D:
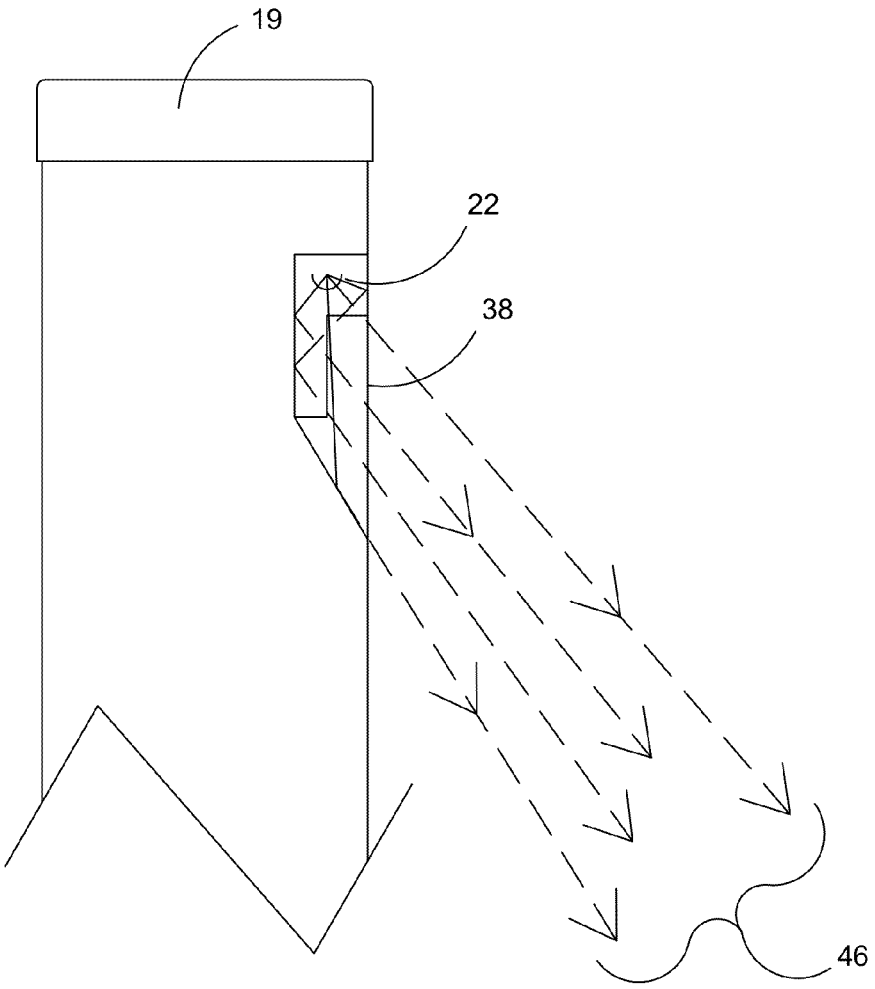
FIG. 1D is an enlarged side elevation view of FIG. 1A showing diagrammatically the light output pattern from that perspective.

Sloped face 54 extends up to edge 52 (FIG. 3A) of the cut notch 50 and can be of similar material as the post and can be welded in place or similarly affixed to become an integral part of the post. The notch 50 in the post 12 allows the light beam to extend outwardly in front of post 12 as well as laterally in opposite directions of post 12 (see FIG. 1B). See also FIG. 1C, which is intended to generally illustrate how fixture 10 spreads the light from it in opposite lateral directions in front of post 12 (but limits the outer opposite edges of the beam in those lateral directions). This creates the long, lateral length 44 of the beam but does not allow substantial light above a horizontal plane through the light source; and also has quite well-defined edges. FIG. 1D is intended to generally illustrate how fixture 10 also creates the width 46 of the light beam along its length (but limits the beam's spread and opposite edges along its length). This creates the narrow width of the beam compared to its substantially longer length. One example of beam dimensions along a pathway would be thirty feet long (15 feet laterally on each side of post 12) and a plurality of feet wide (e.g., 3 or 4 feet forward of post 12). Of course, these dimensions can vary according to need or desire of the designer.

The perspective and isometric views of the exterior of light 10 in the Figures give an idea of what light 10 looks like from multiple directions. Note how it has a clean exterior appearance. It appears as a rectangular or square post. Note how fixture 10 builds inside the perimeter dimensions of the post the light source, optics, and electric circuitry to generate a rectangular beam pattern to just one side of post 12.

The optical assembly 20 for light source 22 is constructed using an extruded aluminum shape with integral heat sink 24

(see FIGS. 5A-5C) to conduct heat away from the light source 22. The optical housing heat sink 24 includes two L-shaped end plates 90 L and R connected to the extruded shape 24 via fasteners 91 (see FIG. 3A—only one is shown for illustrative purposes) or other suitable means. The optical housing assembly 24 is then affixed to post 12 using rivets 67 (only two are shown in FIG. 3A) or other suitable fasteners through mounting holes 66 in housing 12 into threaded holes 64 of component 24. The optical housing 24 also provides a mounting means for the reflective strips 34 (e.g., fasteners 76 (only one is shown) and holes 77) and 36 (e.g., rivets or screws 72 (only one is shown) through holes 70 into holes 68—see also FIG. 5C) that control and direct the light to the target area 42.

In this embodiment, strips 34 and 36 have reflective surfaces made of very high reflectivity material. An example would be high reflectivity material under the brand name Anolux Miro® IV anodized lighting sheet material (high total reflectance of at least 95%) available from Anomet, Inc. of Brampton, Ontario, Canada. An alternative is silver-coated aluminum (e.g., on the order of 98% or so total reflectance) available from Alanod Aluminum of Emnetepal, Germany. The silver-coated material may have a greater reflectivity (on the order of 98%) but may not be as durable as the aforementioned material. Other materials would be possible. Thus, even though there is some loss of light when reflected, and in this embodiment most of the intensity in the beam 40 (FIG. 1B) is from light reflected at least once (and sometimes two or more times), the high reflectivity surfaces minimize light loss due to reflection and thus promotes high efficiency.

It should be noted that it is recommended that a protective release sheet be maintained over these highly reflective surfaces until just prior to final assembly to minimize potential of adherence of (and lumen depreciation caused by) oils, dust, or other debris (which can affect reflectivity) from handling by workers or from other sources.

It should also be noted that some of the light from source 22 will not strike highly reflective surfaces. For example, as illustrated in FIGS. 11A-E, some light will strike pieces 90 or some light may strike sloped surface 54 (FIG. 3A). In the exemplary embodiments, these surfaces are not highly reflective. They can be painted, for example. Therefore, there may be some light loss because of light absorption or lack of controlled reflection or reflectivity. However, these surfaces are not non-reflective. Therefore, some fraction of light may reflect and contribute to beam 40. For example, sloped surface 54 may assist in directing some light down directly in front of post 12 even though it is not highly reflective.

FIG. 3A shows strips 34 and 36 exploded from fixture 10. FIG. 5C shows where they are mounted for operation. Each is attached directly (by machine screws or other suitable fasteners or methods) to a surface of heat sink 24. What will be called front inside reflector strip 34 is mounted to the inner-facing surface 82 of front, downwardly extending wall 87 of heat sink 24. Strip 34 faces towards light source 22. Note how the inner side of wall 87 of the extruded optical housing is slightly tilted (e.g., 10 degrees) relative light source 22 to throw incident light back towards but somewhat downwardly to the curved reflective strip 36 along the back wall 78 of the optical assembly. In this embodiment, this tilt is created by tapering wall 87 from thicker at the top to thinner at its lower edge. Heat sink fins 84 extend from surface 86 of component 24.

The back reflective strip 36 is affixed to the optical housing rivets 72 or similar fasteners. It is convex (see FIG. 3A) relative to a horizontal plane to project more of the light toward the sides of the beam 40 and less directly in front of post 12. This approach works with the side emitting LED to produce a uniform rectangular light beam pattern 40. To even the beam pattern's intensity, more light needs to be directed to its farther points relative the center of the elongated pattern.

A transparent lens cover 38 (FIG. 1A) is installed on the post 12 to cover the notched area 50 of the support post 12 and optical assembly 20. The lens cover 38 can be constructed of glass, high clarity acrylic or other suitable transparent material. Lens material should be constructed of UV resistant material or contain a UV resistant coating for out-of-doors applications, though materials are not limited to such. It could be made of translucent material, but this would decrease the amount or control of light. Ultimately, lens cover 38 is not required for the correct operation of optical assembly 20, though could contribute to producing a desired beam output, deter theft, or otherwise.

The electrical system provides the required power and circuitry to drive LED light source 22. The input power is 0-24 volts DC. The electronic circuit to power the LED source includes a constant current driver 26 (see, e.g., FIG. 6), such as BuckPuck Model 3021 from LuxDrive of Vermont, USA. These are commercially available. Details can be found in Document COM-DRV-3021-00, previously incorporated by reference.

The DC input power for the LED 22 can be achieved by various means. Typical 120V AC house power can be converted to DC using a centrally located AC to DC transformer of the appropriate size with DC power routed to the pathway lights 10. Alternately, an AC to DC transformer or converter could be included in the electrical system at each of the pathway light 10 locations. This will allow routing 120V AC power to each light source 22 if desired. Another option would be to power the light 10 using a rechargeable DC power source with photovoltaic recharging system (not shown) mounted at each of the post locations, or a centrally located, larger photovoltaic system for plural lights 10. A solar power system and DC battery storage would need to be sized to provide power for the duration of time that the lights will be operated, allowing for some reserve power in case of days with reduced sunlight to allow the system to become fully recharged.

Light 10 could be configured in a portable mode. An option suitable for a portable system is to use small DC alkaline batteries 28 (FIG. 6) such as four AA batteries. In such a system, an on/off switch (see FIG. 10B) could be provided to manually turn the lights on. A dimmer switch (not shown) could also be installed at each location.

The electrical system comprises commercially available components and is easily constructed by those familiar with LEDs and the electronics field. The electrical circuit board or plate 58 is installed inside the tubular post housing (e.g., with fasteners (not shown) into aligned holes 62 and 60—see FIG. 3A).

The Figures illustrate how fixture 10 is constructed, and the configuration of its parts. FIGS. 11A-E, in the context of the other Figures and description, are intended to roughly diagrammatically illustrate how fixture 10 generates rectangular beam pattern 40. First, side-emitting single LED source 22 is mounted upside down. A horizontal plane through the side-emitting lens of source 22 is very close to the plane of the inside ceiling 80 of optical housing/heat sink 24 (see FIG. 11C). The LED lens spreads light radially generally in its horizontal plane. But note how side members 90 (particular inner-facing sides 96, as opposed to outer side portions 92, 94, and 98 (see FIGS. 7A and 7B)) are directly in line, on opposite lateral sides of source 22, with the side-emitted beam. Likewise, inside reflective surface 34 (in front of source 22), and back reflective surface 36 (close and behind source 22), along with top surface 80 (see FIG. 5C) and side members 90, basically box-in the side-emitted radial radiation from source 22 (see FIGS. 11C-D). As noted earlier, the front wall 87 of heat sink 24 basically hides LED 22 from view. Therefore, the initial radiation from side emitting LED 22 does not travel directly out of fixture 10. Rather, it is controlled to produce the rectangular pattern 40 (FIG. 11A) having sides AB and CD elongated in opposite lateral directions defining a relatively long beam length, and sides AC and BD defining a relatively narrow beam width. Note in FIGS. 8A-B and 9A-B that notches 35 and 37 respectively, can be formed in pieces 34 and 36 for clearance of the base of the light source 22 if needed (not illustrated in FIGS. 11A-E).

As indicated roughly in FIGS. 11A-E, the radial side-emitted light from source 22 is manipulated in at least the following ways. The inside reflective surface 34 is tilted forwardly slightly to receive direct radial light from source 22 all along its length and reflect it efficiently down and back towards convex reflective back surface 36. Back surface 36 then re-reflects that light downwardly but forwardly (see FIG. 11E). But because of its curved convex shape (in the horizontal plane), it also spreads that light laterally in both directions (see FIGS. 11B and D). These components and their cooperation are selected to produce the rectangular pattern 40. But also, they are selected to generally produce at least somewhat even intensity throughout pattern 40. This is accomplished by enclosing source 22 in the box-like structure that includes surfaces 34 and 36, as well as ceiling 80 and the inner surfaces of side members 90. The elongated lateral or horizontal length of surfaces 34 and 36, and the placing of the source 22 along the middle of those pieces, is intended to distribute increasingly more light in the pattern 40 farther away from source 22. Those portions will be placed in the pattern to achieve general uniformity of intensity throughout the illumination. This can be achieved using empirical methods by and knowledge of those skilled in the art.

As indicated in FIGS. 11A-E, cut-off at sides AB, CD, AC, and BD of beam pattern 40 can be somewhat sharp. This is controlled by reflecting the radial side emitting pattern of LED 22 off of rectangular-shaped reflective surfaces 34 and 36, as well as positioning of the side members 90. One skilled in the art can adjust these things to achieve variations in the beam pattern.

The reflective surfaces of pieces 34 or 36 could be integral to those pieces. Alternatively, they could be a layer or coating that is applied over a substrate or support member. Note that surface 36 can be on one side of a piece of relatively uniform thickness that is formed into a curved shape. Mounting holes 68 in heat sink 24, and through-holes 70 in piece 36, can be designed so that mounting of piece 36 to heat sink 24 will hold piece 36 in compression to urge it to bulge out and retain its curved shape and resist flattening out. There could be spacers or supporting material behind it to help retain its shape.

E. Exemplary Method and Apparatus Embodiment 2

Figure 2A:
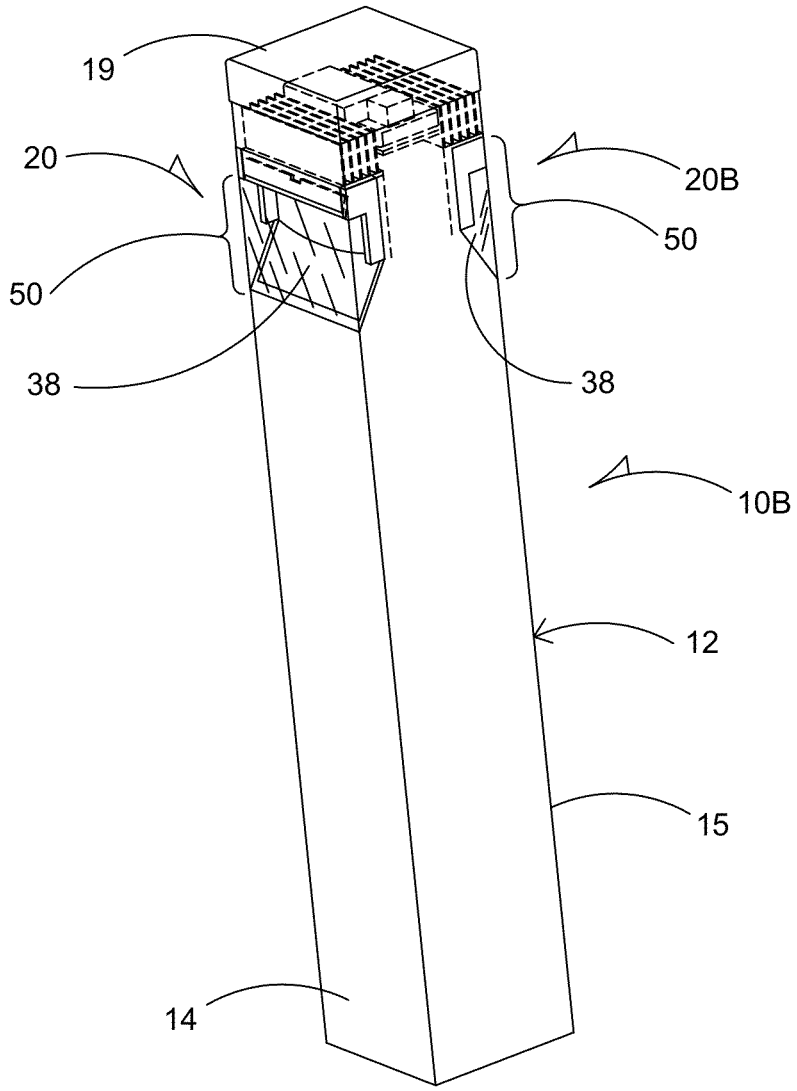
FIG. 2A is a perspective view of a second exemplary embodiment according to the present invention, having light output patterns from opposite sides of the device.
Figure 2B:
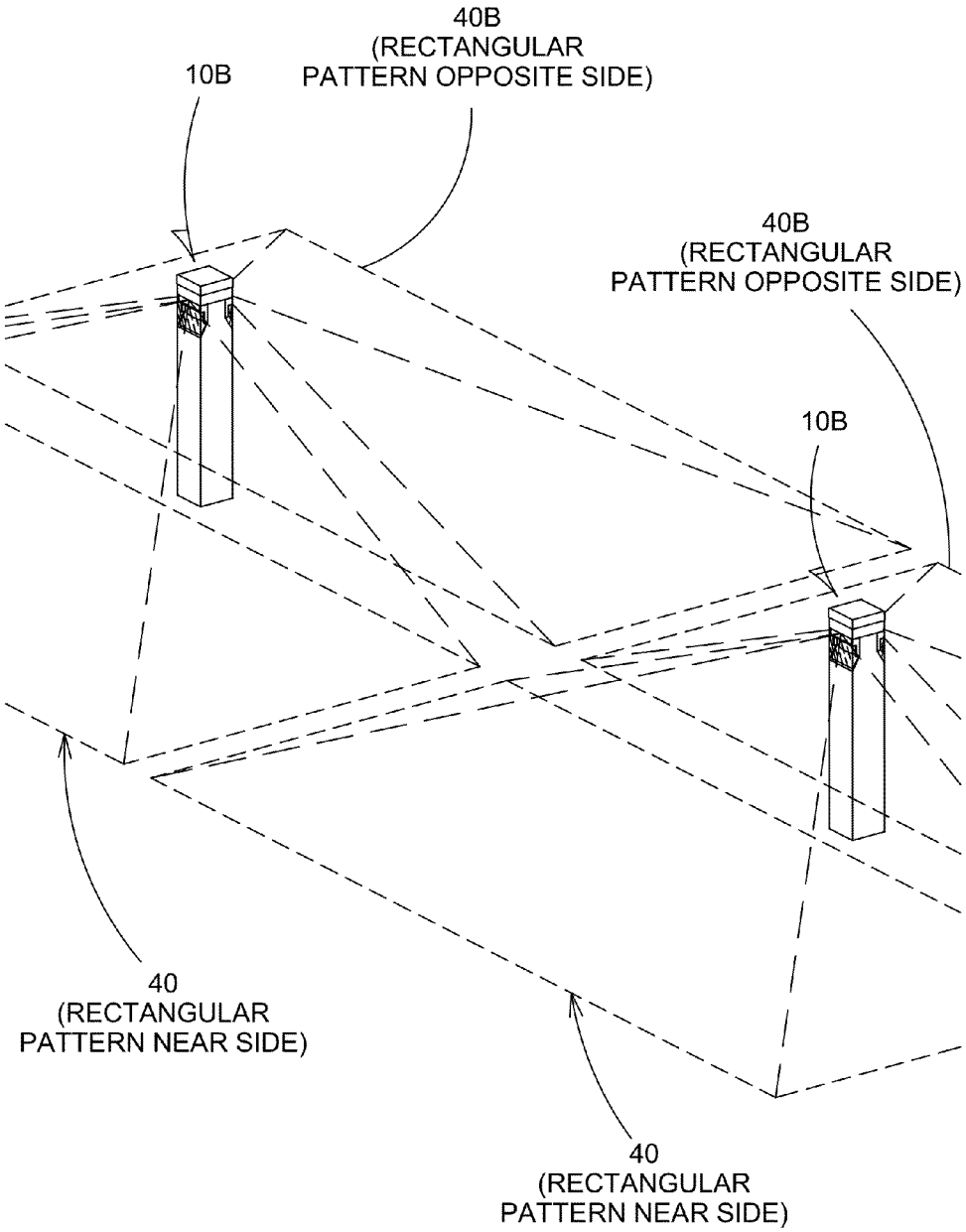
FIG. 2B is a reduced-in-scale perspective diagrammatic view of two pathway lighting devices of FIG. 2A and lighting patterns projected therefrom relative a pathway.
Figure 2C:
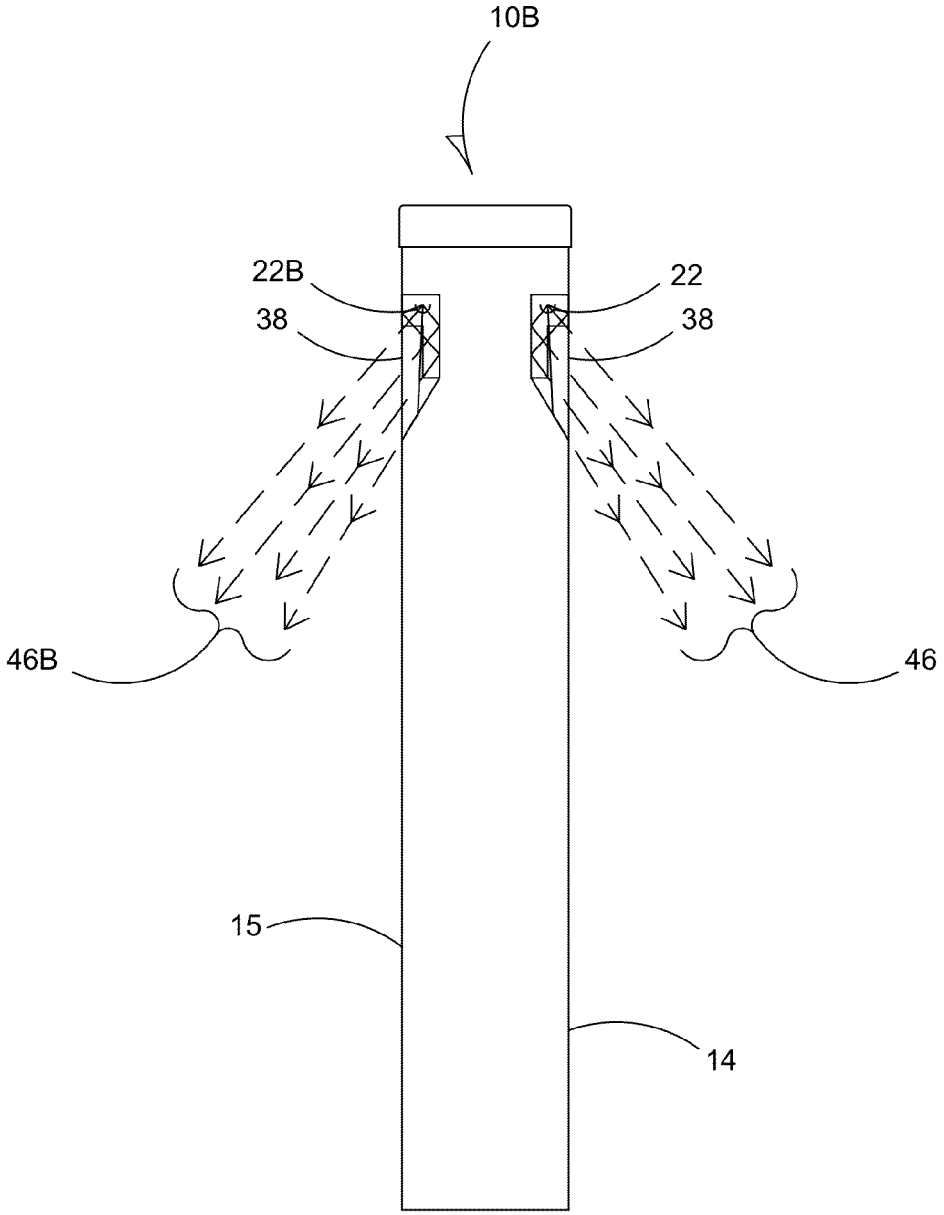
FIG. 2C is a side elevation view showing diagrammatically light output patterns from the device of FIG. 2A.

FIGS. 2A-C illustrate another exemplary embodiment according to the invention. A fixture 10B would use most of the same or similar components to those of Embodiment 1, but include a second cut-out 50 on the back side 15 of post 12 and a second optical assembly 20B (optical housing/heat sink 24 with reflective surfaces 34 and 36, and second LED 22B). This would not only provide light output 40 from the front side 14, as discussed above, but another pattern 40B from the opposite side; width of front and back beams (reference numbers 46 and 46B, respectively) are similar to that in Embodiment 1. In this embodiment, fixture 10B is used to illuminate two different areas from within a single fixture location. The front and back light patterns 40 and 40B can be identical or different to suit the needs of each area by design and selection of the light sources and optic system; ways to alter the light beam size and shape are discussed later.

Post 12 for the present embodiment contains notch 50 in front face 14 and a second notch 50 in back face 15 to accept a second optic housing 24. A single electrical circuit board 58 could be configured to provide power and circuitry to both light sources 22 and allow for independent or simultaneous control, as required or desired.

Additional light sources 22 can be added to a single post housing 12 in a similar manner. For example, an additional notch 50 could be formed in one or both of the sides between front 14 and back 15 of post 12 to project third or fourth beams from either of those sides. Alternatively, one or more additional notches 50 could be formed at other vertical height(s) on post 12 to create mounting locations for more than one beam from a single side of post 12.

F. Exemplary Method and Apparatus Embodiment 3

Figure 3B:
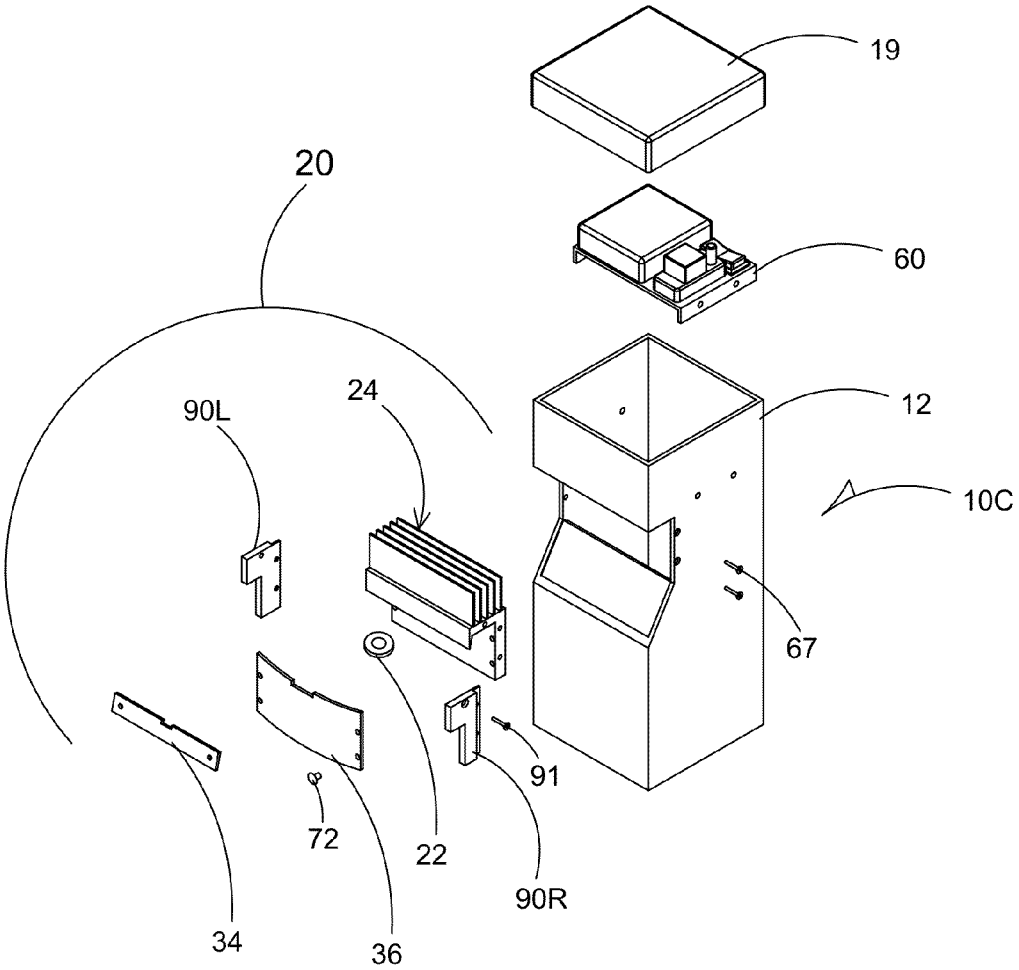
FIG. 3B is similar to FIG. 3A but for an alternative mounting housing.
Figure 4A:
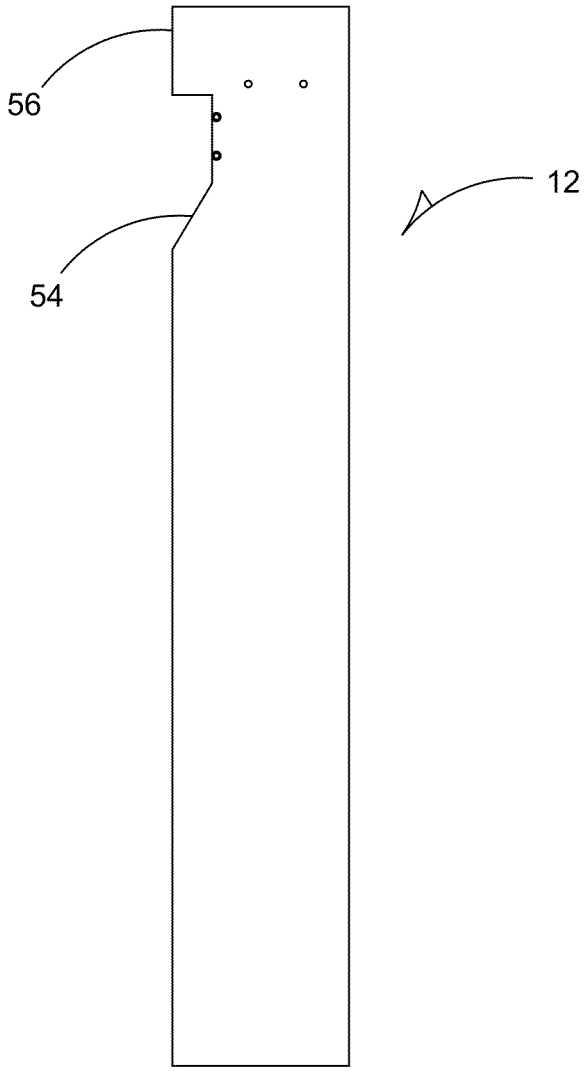
FIG. 4A is a side elevation isolated view of the base housing for FIG. 3A.
Figure 4B:
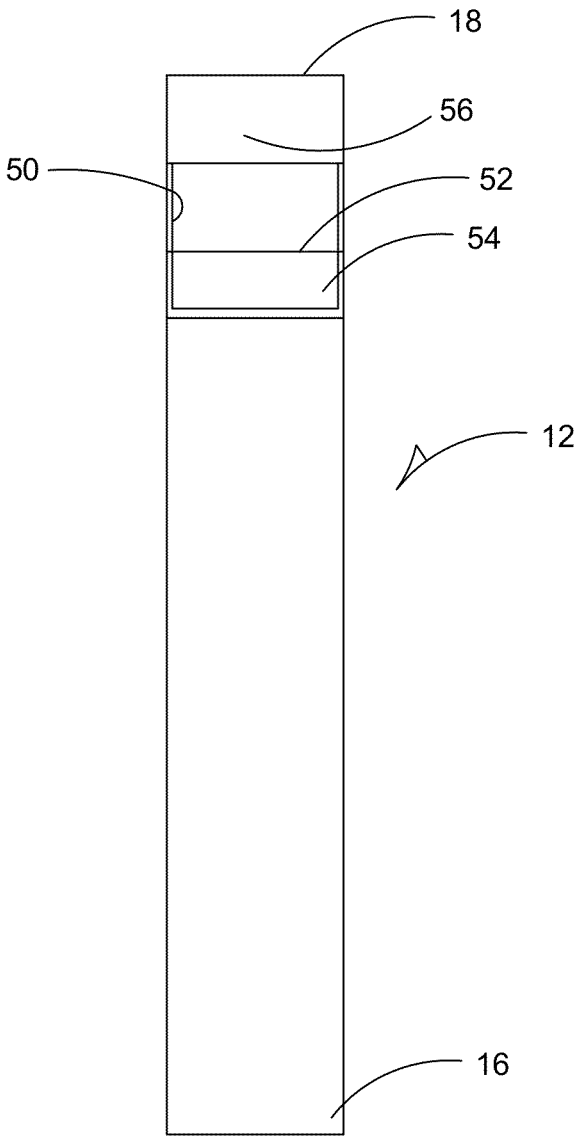
FIG. 4B is a front elevation view of FIG. 4A.
Figure 4C:
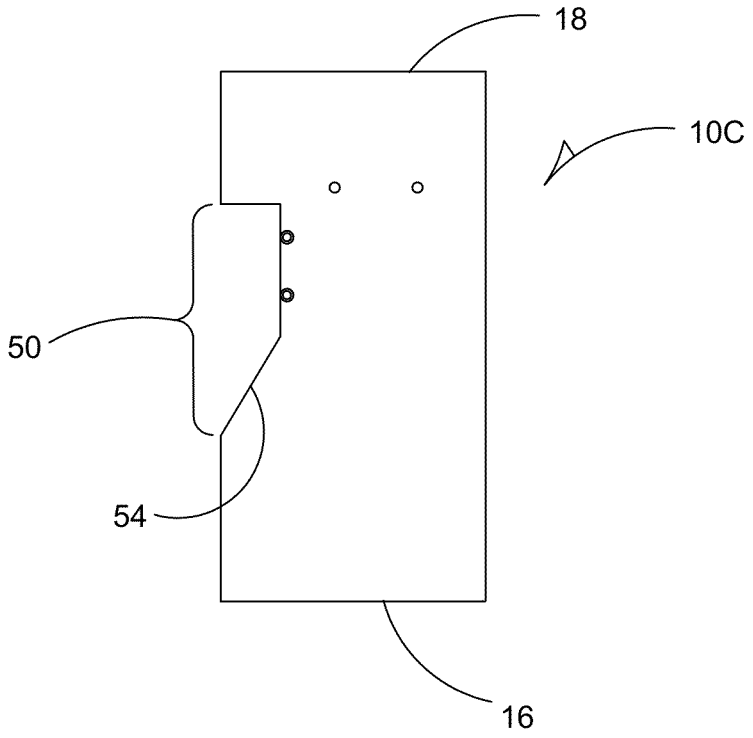
FIG. 4C is a side elevation of the isolated base housing of FIG. 3B.
Figure 4D:
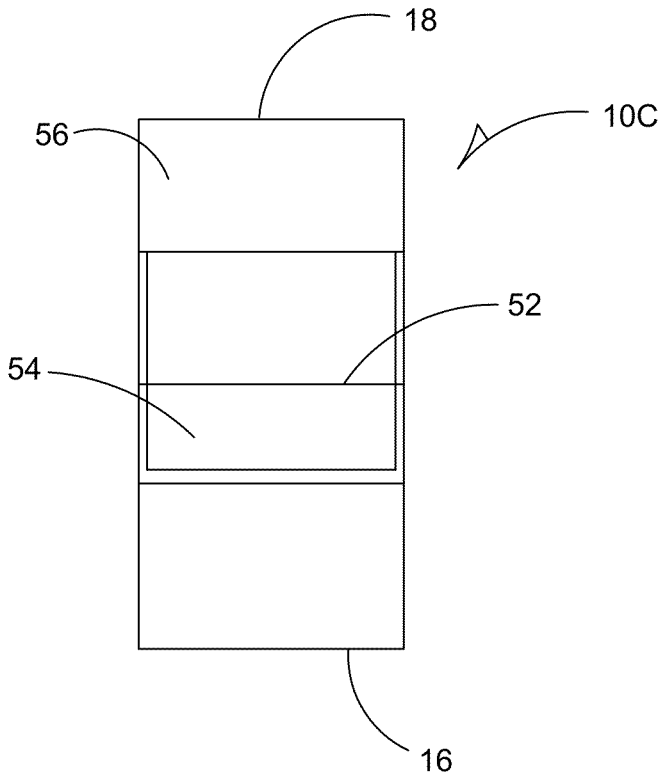
FIG. 4D is a front elevation of FIG. 4C.

FIGS. 3B and 4C-D illustrate another exemplary fixture 10C (a third embodiment) which could use many of the same or similar components of the fixture of Embodiment 1. The main difference is that instead of a substantially elongated post or bollard 12 of fixture 10, fixture 10C would use a much shortened post 12. This version could be used to light pathways from a position closer to the ground. Alternatively, this version could essentially convert the tubular housing into a small box-like housing suitable for mounting on other supports, such as wall mounting. Fixture 10C, when mounted along an exterior vertical wall of a building, could be used to illuminate areas that are adjacent to and along the building wall or face, what is sometimes referred to as wall washing. Alternatively, fixture 10C could be mounted on top of or along another post or pole or structure (e.g., a solid square wood post). Ways to alter the light beam size and shape will be discussed later.

The housing of fixture 10C can be constructed in various manners and from similar materials as in Embodiment 1. Construction of such a housing is familiar to those in the lighting field. The outward face contains a notch 50 similar to the fixture of Embodiment 1 to accept the same or a similar optic housing, light source, and other components. The electrical circuit can also be similar to that in Embodiment 1.

G. Exemplary Method and Apparatus Embodiment 4

Figures 12A, 12B:
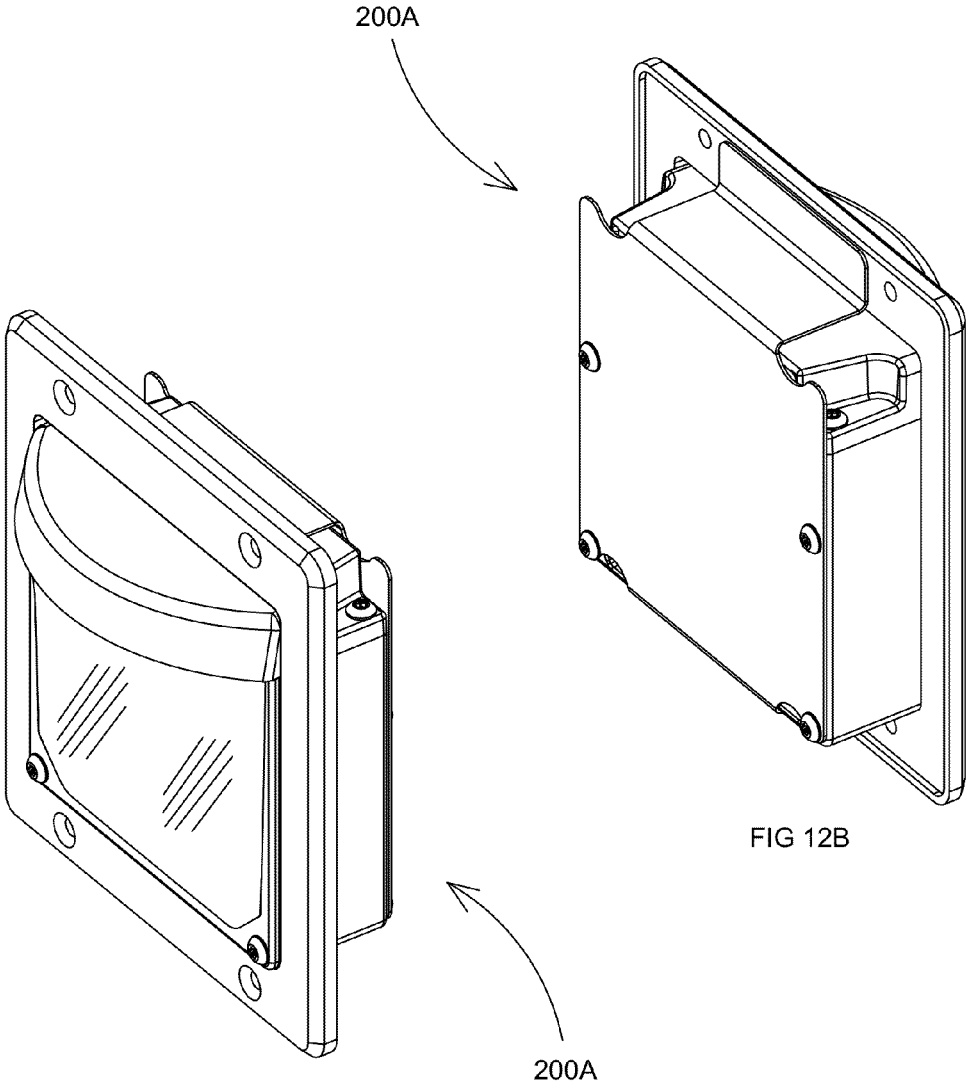
FIG. 12A is a perspective view of another embodiment according to the invention.
FIG. 12B is a perspective view of FIG. 12A from an opposite side.

Another exemplary embodiment is similar to Embodiment 1 but is designed as a self-contained unit. FIGS. 12A and B illustrate assembled module 200A with front and back views. Embodiment 4 includes a bracket 201 (see FIG. 13) which is used to attach the fixture essentially wherever desired. Among potential mounting sites are: posts, either on the surface or in notches or recesses; wall surfaces, either on the surface or in a recess, electrical-type box, etc.; or any other surface or structure. This allows the width of coverage of a pathway by the light beam to be adjusted simply by varying the angle from vertical at which the bracket is attached. If a wider beam is desired, the bottom of the mounting can be tilted (e.g., shimmed) out from the mounting surface. If a narrower beam is desired, the top of the mounting bracket can be tilted (e.g., shimmed) out from the mounting surface. Optical design is essentially similar to previous embodiments.

1. Embodiment 4

Optical Design

Embodiment 4 (generally at ref. No. 200A) has been designed similarly to previous embodiments; however, its particular design allows it to be flush mounted in a post or wall with no side notch necessary. The projection of the cap and the design of the optic system allows a 180° side beam projection within approximately one inch of the mounting surface. The following optical details are particular features of Embodiment 4 but are essentially the same in general scope as the optical details of the previous embodiments.

Figure 17:
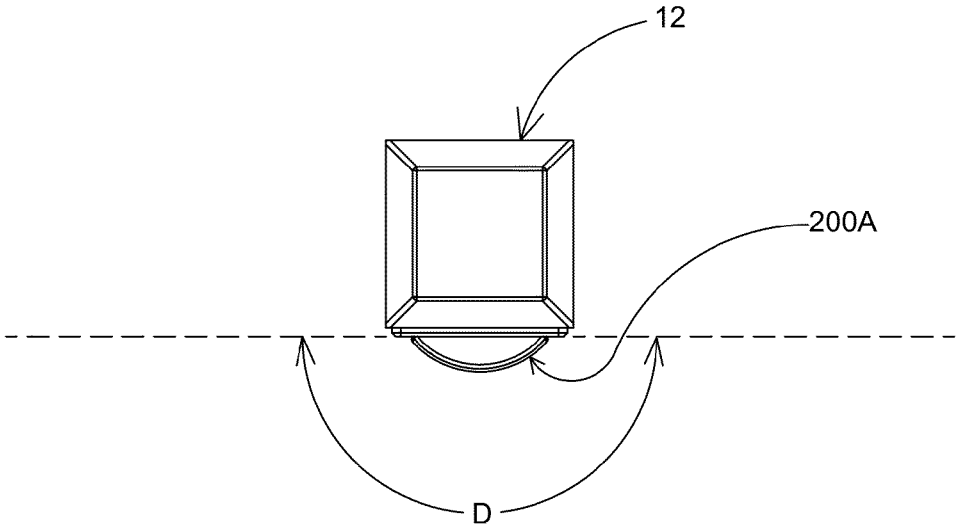
FIG. 17 is a reduced-in-size top plan view of FIG. 12A installed on a bollard-type post.

FIG. 17 shows a top plan view of module 200A as typically installed in a post 12. It illustrates the horizontal beam spread ∠D of 180°, projected on the ground within approximately one inch of the mounting surface (from a mounting height of 2.5 feet, though other mounting heights are possible). This means that because of the optical design, the fixtures are able to project a beam that is relatively well defined along a straight path. This beam spread ∠D is exemplary and could be less or more according to desired effect.

Figure 18:
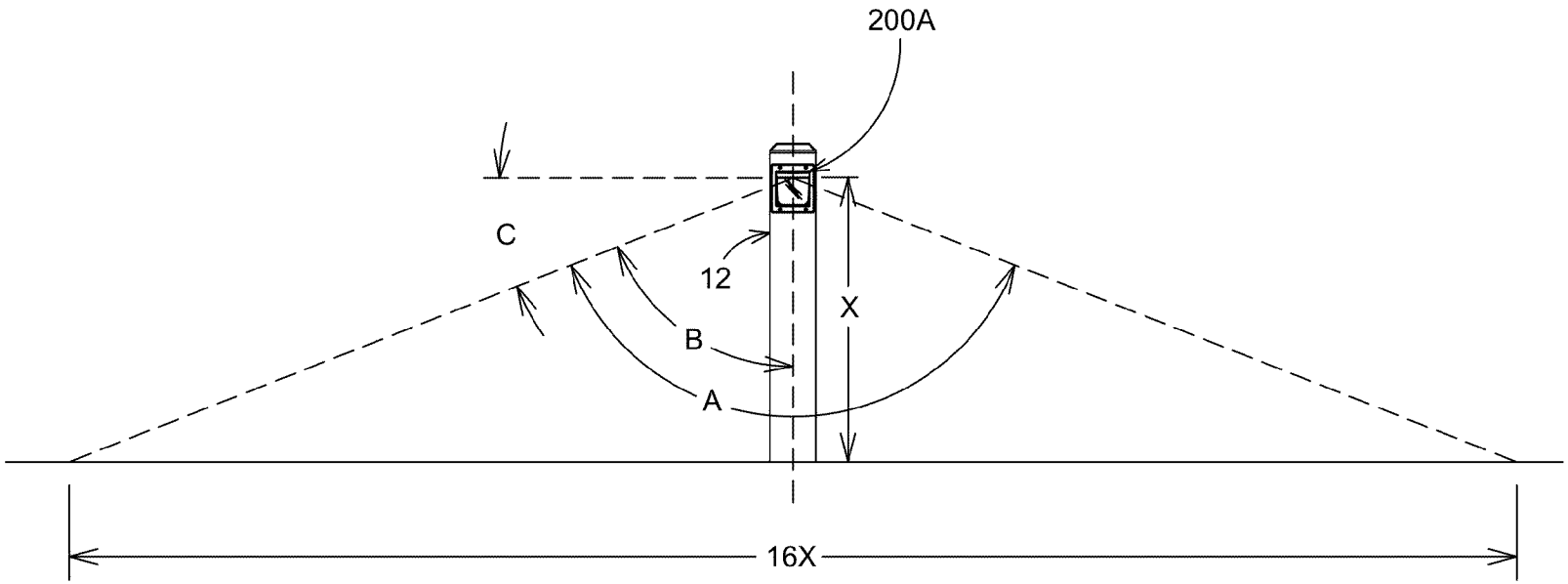
FIG. 18 is a further reduced-in-size front elevation of the embodiment of FIG. 12A mounted on a bollard-type post with diagrammatic illustration of one example of beam spread.

FIG. 18 illustrates the vertical beam spread of module 200A. As embodied, the light emitted side-to-side has a total beam spread ∠A of 140°, or ∠B 70° from nadir, which is ∠C 20° from horizontal. An additional alternative embodiment has a beam spread of ∠A of 110°, or ∠B 55° from nadir, which is ∠C 35° from horizontal. These angles are exemplary and allow for different placement of the fixtures to achieve desired light levels, spacing between fixtures, coverage, etc. Other angles/beam spreads could be designed as well.

FIG. 18 also shows an exemplary beam pattern viewed from the front. It illustrates that as embodied (using the previously mentioned total beam spread ∠A of) 140°, the length (e.g., along a pathway) of the beam is approximately 16 times the mounting height ("X") of the fixture. Thus a mounting height of 2.5 feet would give a total beam length along a pathway of 40 feet. A mounting height of 5 feet would give a total beam length along a pathway of 80 feet, and so on. This would allow for differing designs, LED power levels, etc. in order to meet the needs of a particular situation. Different designs for beam spread angles would, of course, provide additional options for beam length.

Figure 19:
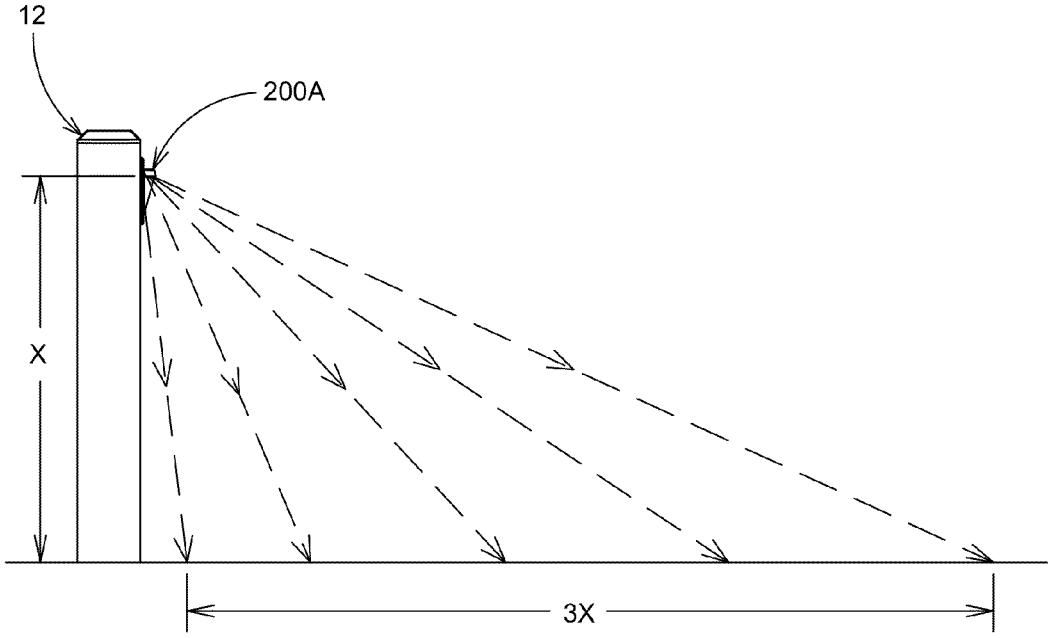
FIG. 19 is a side elevational view of FIG. 18 with diagrammatic illustration of one example of beam spread.

FIG. 19 illustrates a similar projection of an exemplary beam pattern as embodied, showing that from the side, when the fixture is mounted essentially vertically, the beam pattern is approximately 3 times the mounting height ("X") of the fixture. Thus a mounting height of 2.5 feet would give a total beam pattern across the width of a pathway of 7.5 feet. A mounting height of 5 feet would give a total beam pattern across the width of a pathway of 15 feet, and so on. Again, this would allow for differing designs, LED power levels, etc. in order to meet the needs of a particular situation. Different designs for beam patterns would of course provide additional options for beam width across pathways, etc.

2. Details of Embodiment 4

Figure 13:
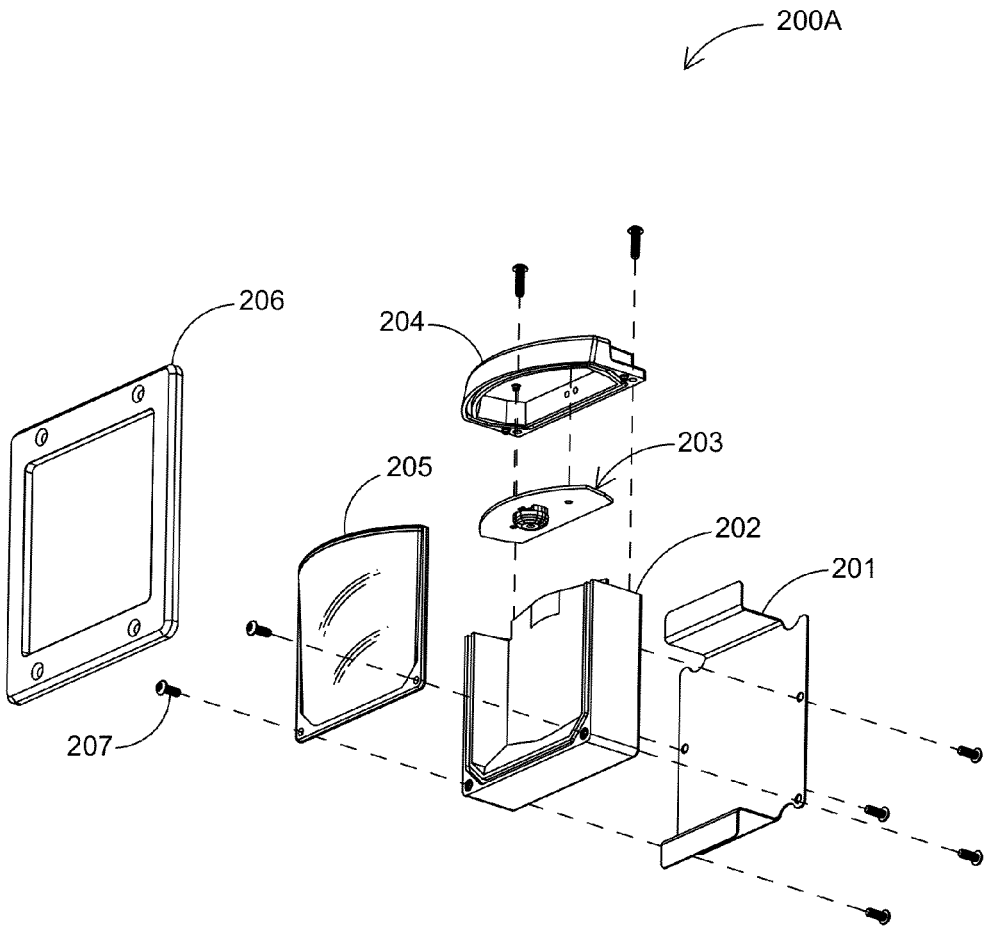
FIG. 13 is an exploded view of FIG. 12A.
Figure 14A:
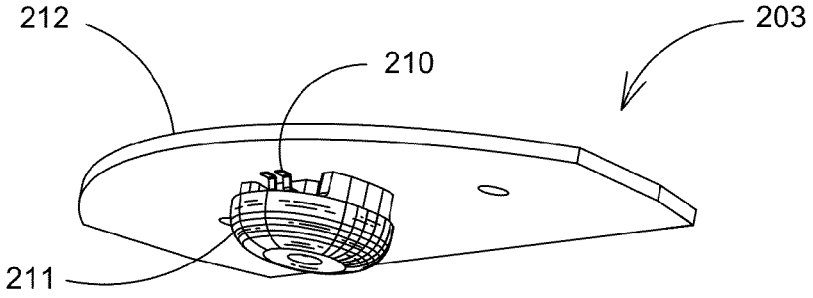
FIG. 14A is an enlarged perspective view of a light source from FIG. 13.
Figure 14B:
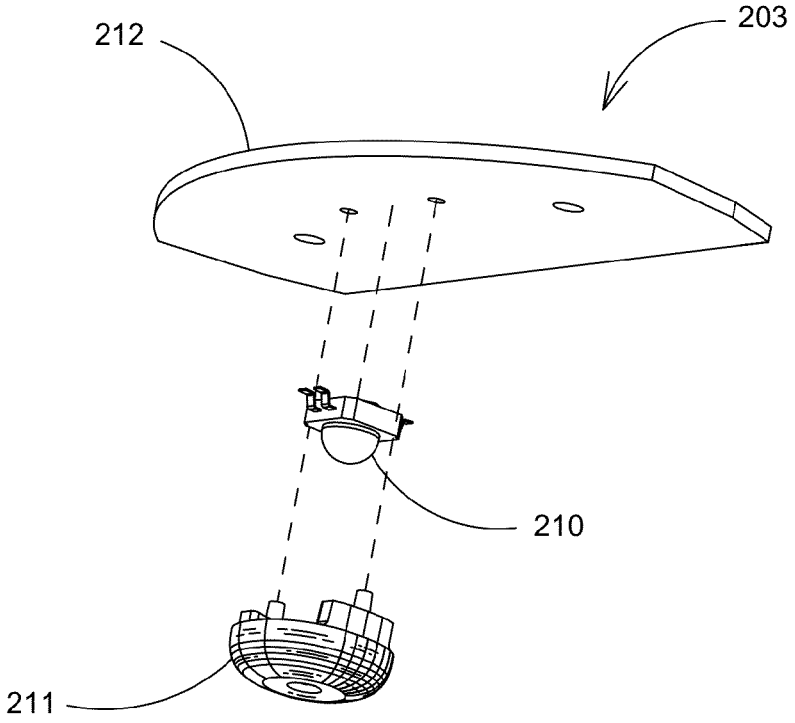
FIG. 14B is an exploded view of FIG. 14A.
Figure 15A:
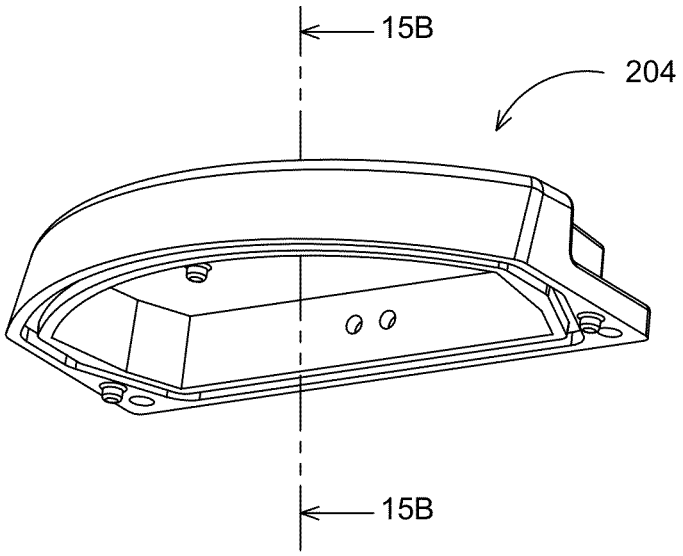
FIG. 15A is a perspective view of a cap from FIG. 13.

Module 200A of FIGS. 12A and B is illustrated in exploded view in FIG. 13. It comprises a bracket 201 which is attached to the main housing/reflector 202. The main housing includes the cap 204 (see also FIGS. 15A and B), LED circuit board assembly 203, front lens 205, and bezel 206. Circuit board assembly 203 (see FIGS. 14A and B) includes LED 210, lens 211, circuit board 212. In this embodiment, LED 210 emits a Lambertian pattern. Lens 211 converts the beam to a non-Lambertian pattern. Screws 207 (see FIG. 13) or other fastening means or methods may be used to assemble the components.

Main housing 202 (see also FIG. 16) has reflective surfaces which control and direct the light to the target area. Surface 222 is reflective and generally convex relative to LED 210. Surface 221 and its companion on the opposite side are reflective as well, and reflect light to the sides. Surface 223 reflects light from the LED 210 generally forward (i.e., outwardly from module 200A). Surface 220 is an optional reflective field within surface 222 having a different surface texture. This surface helps to soften and disperse light which could otherwise tend to create a "hot spot" of illumination directly in front of the fixture.

The reflective surfaces could be metallized via surface deposition on an injection molded substrate having a specific surface texture. Alternatively, they could be machined as part of the housing, which could be aluminum or other material, then polished or treated to attain a specific surface texture or reflectivity. The reflective surfaces could also be separate pieces of reflective material such as metallized plastic, reflective film, polished aluminum, or other materials which can be manufactured to a specific surface texture and reflectivity. Reflective surface 220 could be formed simply by creating a different texture on a die-casting mold, by using a different machining process from the rest of the reflective surface 222, or applying a film or other component.

Figure 15B:
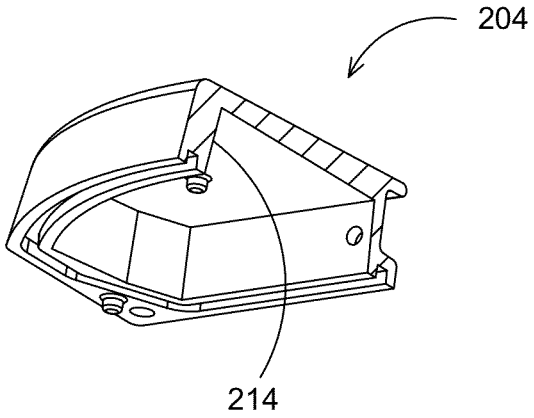
FIG. 15B is a sectional view of FIG. 15A along line 15B-15B.
Figure 16:
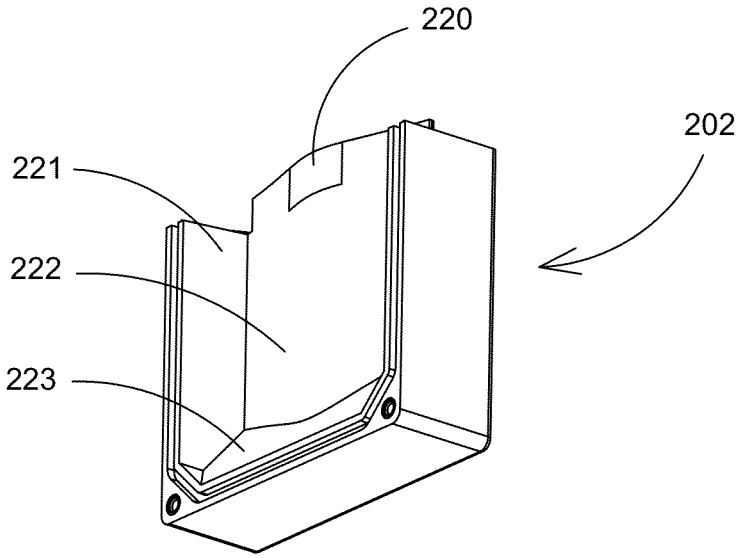
FIG. 16 is an isolated perspective view of a base housing from FIG. 13.

The front face 214, FIG. 15B, of the cap 204 is sloped slightly outwardly to throw a portion of the light forward while redirecting another portion back towards the curved main reflective surface 222, FIG. 16, along the back of the optical assembly. A heat sink in contact with circuit board assembly 203 is incorporated in the cap. The other interior surfaces of cap 204 may also have a reflective surface, depending on application.

The general shape of the reflective surfaces serves to project more of the light toward the sides and less directly in front. This approach works with the LEDs to produce a uniform rectangular light beam pattern. The transparent lens cover 205 is installed on the fixture. The lens cover can be constructed of glass, high clarity acrylic or other suitable transparent material. Lens material should be constructed of UV resistant material or contain a UV resistant coating, and could be designed so to shape the light projected from LED 210, if desired.

H. Exemplary Method and Apparatus Embodiment 5

FIGS. 20A-26D illustrate another exemplary embodiment according to the present invention. As in Embodiment 4, the present embodiment is self-contained and utilizes a standard LED (i.e., not side-emitting); any of the XP models available from Cree, Inc., Durham, N.C., US are one example. Unlike Embodiment 4, module 200B (see FIGS. 20A and B) does not rely on internal reflections (e.g., off surfaces 220, 221, 222, 223 in Embodiment 4) combined with what is essentially a side-emitting lens (see reference no. 205) to produce the desired beam output; rather, in Embodiment 5, a plurality of LEDs are molded around a boss such that the light from each LED contributes to a composite beam which can be tailored to suit an area. A primary benefit of the present embodiment is that multiple light sources are used in the same physical space (i.e., post 12) as previous embodiments; this allows more light to be placed on the target area, potentially reducing the number of bollards needed for a pathway lighting application (or other application benefiting from aspects of the present invention).

With respect to FIGS. 20A and B, module 200B generally comprises a mounting base 230, an optional sealing member 231, an LED assembly 232, and an outer lens 233. In practice, LED assembly 232 is conformed to boss 235 of base 230, wiring is routed out apertures 236, optional sealing member 231 is placed about boss 235 and flush against face 237, lens 233 is centered on base 230, and the assembly is tightened down via screws 234. As designed, base 230 is aluminum or some other conductive material so to act as a heat sink when module 200B is installed (see FIGS. 24D and 25D).

FIGS. 21A-E illustrate LED assembly 232 in greater detail. LEDs 243 are affixed to a circuit board 244 according to methods well known in the art. Circuit board 244 typically comprises a substantially conductive metallic base 245, an electrically insulative layer 246, copper traces 247 for connecting LEDs to the circuit, and wiring 300 for power; however, other configurations of circuit board are possible, and envisioned. Board 244 further includes notches 248 on the surface opposite that proximate LEDs 243 (see FIG. 21C). The exact number and placement of notches 248 determines how LED assembly 232 is conformed to boss 235; one possible conformation is illustrated in FIGS. 21D and E, though other conformations are possible. Ideally, placement of notches 248 in board 244 is such that light emitted from each LED 243 blends smoothly with the light emitted from the other LEDs in assembly 232, and in a manner that produces the desired lighting pattern when module 200B is installed in a desired operating position (see FIGS. 24A-25D).

There is a concern that bending board 244 could impart significant stresses on traces 247. If desired, a flexible printed circuit connector 249 (see FIGS. 22A and B)—sometimes referred to as a FPC—could be applied to board 244 such that traces 247 are routed through FPC 249. As envisioned, FPC 249 comprises a non-conductive flexible substrate 250, conductive traces 251, and pads 252 for soldering to corresponding pads on board 244 (diagrammatically illustrated by lines 253). In practice, FPC 249 is soldered to board 244 before board 244 is bent. In operation, power from wire 300 travels to a first LED 243 via board 244, across a first section of FPC 249, to a second LED 243 on board 244, across to a second section of FPC 249, and so on such that LEDs operate in series; however, FPC 249 and board 244 could be designed to operate LEDs in parallel or in some combination of parallel and series circuits, if desired.

With regards to FIGS. 23A-D, lens 233 is formed to receive boss 235, thereby positionally affixing LED assembly 232, while also transmitting light (at least partially light transmissive) emitted from LEDs 243. The exact design of lens 233 can vary depending on the application, desired beam pattern, number of LEDs in assembly 232, etc., but generally lens 233 comprises a primary transmitting face 240, an upper face 239, and upper and lower bosses or alignment tabs 241 and 242, respectively, for positioning lens 233 relative boss 235. A primary benefit of lens 233 is that it is designed to operate with multiple light sources thereby simplifying the design while effectively providing each light source with its own optic. Further, because portions of lens 233 can be blackened (e.g., upper face 239) a single device can act both as an optic and as a visor (i.e., provide a distinct cutoff) for multiple light sources.

Like the previous embodiments, module 200B may be installed in a bollard-type post 12 with associated electronics (e.g., FIG. 6) so to produce a lighting fixture suitable for pathway lighting; this is illustrated in FIGS. 24A-D. As can be seen, module 200B is installed so to prevent direct viewing of the source (as in previous embodiments), which can cause glare. If desired, the interior surfaces of post 12 can also be blackened so to prevent any internal glow. Fixture 10D produces a beam pattern 40 comparable in shape to those in previous embodiments, but with greater intensity due to the increased number of light sources. In this first operating position, a mounting height of X will correlate to a generally rectangular beam output pattern of 5× by 0.75× (see FIGS. 24B and C); thus, a mounting height of 4 feet correlates to a rectangular beam pattern measuring 20 feet by 3 feet.

A second operating position is illustrated in FIGS. 25A-D (see fixture 10E). Because module 200B does not rely on one or more reflections to produce a desired beam output, module 200B could be directly affixed to the exterior of a post 12 (see FIG. 25D); in this second operating position, surface 239 of lens 233 will likely be blackened to prevent any uplight which could be bothersome to pedestrians or the like. The result is a generally elliptical beam output pattern wherein a mounting height of X generally correlates to a beam pattern measuring 6× by 1.5×; thus, a mounting height of 4 feet correlates to an elliptical beam pattern measuring 24 feet by 6 feet.

I. Options and Alternatives

As mentioned previously, the invention can take many forms and embodiments. The foregoing examples are but a few of those. To give some sense of options and alternatives, a few examples are given below.

1. Alternate Light Beam Patterns

The exemplary embodiments are designed to provide a long and narrow beam pattern for fairly straight pathways or areas. For curves, path junctions, areas of interest, landscape and the like, different light beam shapes might be desirable. The exemplary embodiments can be modified or constructed to accommodate these conditions. A few examples will be given for illustration of modifications that could meet different needs or applications.

A semi-specular material can be used in place of highly reflective strips or surfaces to create a wider beam pattern. For example, the curvature of the front reflective strip 36 of Embodiment 1 can also be altered to focus more of the light near the fixture location, or to follow a curve in the pathway. For path junctions, light sources can be configured perpendicular to one another to illuminate a crosspath. For landscaping areas or special areas of interest, a more circular beam shape may be desired.

Another method of modifying the size and shape of the beam output pattern is generally illustrated diagrammatically in the cross-section elevations of FIGS. 26A-D, in this example for Embodiment 5, though this approach could be used in any of the embodiments. Module 200B could be pivoted (by any number of mounting methods) (see FIG. 26A) above or below horizontal or moved (see FIG. 26C) further into or out of the interior of post 12. The cutout in post 12 could be deeper or more shallow (see FIG. 26D) or could be angled relative to module 200B (see FIG. 26B). Any of these approaches could be used to develop a customized beam output pattern, though care should be taken to avoid aforementioned "hot spots" (i.e., poor lighting uniformity at the target area).

Another method of modifying the size of the light beam is to vary the mounting height of the light module. As the height is increased, the length and width of the light beam is also increased. The opposite is true if the height is decreased.

For areas where light is not wanted, a shield may be used to cut off the light in that direction. For example, an opaque piece of material could be mounted in the beam path to block light from traveling to or creating intensity in an area. or in the case of Embodiment 5, a portion of the lens could be blackened.

To provide efficient access to different beam patterns, the optic assembly can be constructed to be modular. One optic system producing a light pattern configuration could then be easily exchanged for another optic system with a different pattern size and shape. As illustrated in the exemplary embodiments, the optic system is somewhat modular. The optical housing/heat sink 24, like in Embodiment 1, with attachments, can be removed as one assembly, and substituted with another (of same or different beam pattern output). Reflective surface 36 can be independently removed or installed. Therefore, it could be changed out, if desired. This is true, too, of reflective piece 34. Side pieces 90 of different shapes could also be substituted. Note however, that if desired, one or more of reflective member 34 or 36 could be a more permanent surface. For example, a highly reflective coating or layer or piece could be permanently applied to the relevant surface of heat sink 24. Pieces 90 could be built-in or integral in sub-housing 24. In those cases, an inventory of components 24 with different characteristics would have to be available. In the case of Embodiment 5, said reflective pieces could be blackened before placement in post 12 or completely omitted from the design and relevant interior surfaces of post 12 blackened directly so to reduce internal glow.

2. Alternate Power and Control Methods

There are many different methods of powering the LED light sources and for providing on/off control. The LED light sources for the exemplary embodiments contemplate DC-type voltage in the range of 0-24 volts.

For 120 volt AC power, conversion to DC may be required. This can be converted at a central electrical location prior to routing to each fixture location. Alternately, an AC to DC converter can be included in the electrical system at each fixture location.

The exemplary embodiments can also be powered using a DC battery-type power supply with a photovoltaic recharging system. These types of systems are commonly referred to as solar powered. The battery storage device should be sized to have some reserve capacity for days with less sun exposure and insufficient recharge power to operate the lights for the desired time.

The control system used can be as simple as turning the light on and off. Alternatively, there could be circuitry to provide optimal dimming levels. For on/off control, a photosensor (any of a number of commercially available types) can be installed at each fixture location or at a central location. When the sensor detects low ambient light, a signal can trigger the lights to turn on. Another simple on/off control is with a time sensor that allows power to the lights for a set period of time and prevents power for an "off" time. A more sophisticated system of control may be a remote control system such as the commercially available Control-Link® system, as provided by Musco® Corporation of Oskaloosa, Iowa, (USA).

A motion or occupancy detection type sensor can also be used to trigger the lights to turn on. A time delay could be used with this method to keep the lights on for a preset period. The sensor could be centrally located, or individually located at each fixture. In addition, the sensors could be networked together to allow any of the sensors to provide the signal to activate the lights. Commercially available components exist for these purposes and one of skill in the art could install them into the system.

The light fixtures and the control method can be networked together to allow for groups or regions of lights to respond together. The group of lights could then be turned on or off together, or even dimmed together.

Any combination of the above features could be used.

3. Alternate Light Sources

Embodiments use a solid state light source, specifically a high power LED source. However, alternative solid state light sources are included in this invention. Alternately, non-solid state light sources that are compact, but provide high lumen output per watt of energy can also be considered. Still further, less efficient light sources (including incandescent) could be used.

4. Alternate Methods of Assembly

The methods of assembly described herein are for illustrative purposes and are not limiting. For example, in Embodiment 5 more LEDs could be used. Further, LEDs could be mounted before or after FPC 249 is mounted to board 244. Still further, instead of bending a single board with notches, multiple single LED boards could be affixed to boss 235 (i.e., one LED board per face on boss 235).

As another example, where bolts, screws, and the like are described and illustrated, clamps, welds, glues, or the like could be substituted. Various parts may be formed separately or as a single part; the reflective strips of Embodiments 1-4 are examples. The method of assembly could include additional optical elements such as diffusers or visors. Many other variations are possible, and envisioned.

What is claimed is:

1. A lighting fixture comprising:

a. a housing;

b. an interior chamber in the housing, the interior chamber defined by a top, a bottom, a front, a back, and opposite sides;

c. a plurality of solid state light sources mounted in the interior chamber, each light source having an aiming orientation in generally the same first plane and relative a common reference point in a second plane and a light source output pattern, the plurality of light sources adapted to produce a composite light source output pattern spread across a predefined range in the second plane;

d. a lens proximate and encapsulating the plurality of light sources and adapted to modify the composite output pattern in the first plane;

e. an opening in the housing to the front of the interior chamber having perimeter margins including a top margin beginning below the light sources and extending towards the bottom of the interior chamber, the perimeter margins positioned relative the plurality of light sources to assist in further modifying the composite output pattern produced therefrom; and f. wherein the composite output pattern is elongated with a short axis extending directly out from the housing and a long axis extending to either side of the housing.

2. The lighting fixture of claim 1 wherein the modified composite output pattern projects outwardly and downwardly from the opening in the housing generally below horizontal.

3. The lighting fixture of claim 1 further comprising a transparent or translucent material over the opening in the housing.

4. The lighting fixture of claim 1 wherein the plurality of light sources comprise a plurality of LEDs.

5. The lighting fixture of claim 4 further comprising a heat sink for the plurality of solid state light sources.

6. The lighting fixture of claim 1 further comprising a power regulating component housed in the lighting fixture, the power regulating component adapted to provide variable input power to the plurality of light sources.

7. The lighting fixture of claim 1 wherein light emitted in the direction of the short axis can be reduced or enlarged by modifying vertical, horizontal, or angular position of the solid state light sources relative the top margin of the opening in the housing the plurality of light sources.

8. A method of illuminating a pathway having a length and a width with a substantially opaque bollard-style lighting fixture having a housing positioned along and extending to a top vertically above the plane of the pathway comprising:

a. mounting a lighting module in an opening in and towards the top of the housing of the bollard-style lighting fixture, the lighting module designed to produce a composite output pattern from a plurality of pre-aimed light sources and an associated lens proximate to and encapsulating the light sources;

b. positioning the lighting module relative the opening in the housing of the lighting fixture such that:

i. the composite light output pattern issues from the opening in the fixture and spans a predetermined portion of the length of the pathway, and wherein the composite output pattern is elongated with a short axis extending directly out from the housing and a long axis extending to either side of the housing; and ii. the lighting module is not directly viewable from normal pedestrian viewing angles; and c. providing a cutoff so to restrict the composite light output pattern to substantially the width of the pathway while not substantially illuminating the area beyond the pathway; wherein the providing a cutoff comprises one or more of:

i. interposing an upper margin of the opening in the fixture into a top part of the composite light output pattern; and ii. inserting a reflective visor into the top part of the composite light output pattern.

9. The method of claim 8 wherein the design of the light output pattern is the result of:

a. type and number of light sources;

b. aiming of the light sources in the lighting module; and c. design of the lens.

10. The method of claim 8 further comprising ensuring a minimum lumens to watt ratio for the bollard-style lighting fixture wherein the lumens to watt ratio is determined, at least in part, by the illumination of the pathway.

11. A lighting apparatus comprising:

a. a vertically elevating structure;

b. a housing on the elevating structure;

c. a lighting module mounted at a height in the housing relative to the vertically elevating structure;

d. the lighting module comprising:

i. a base including a boss to which is mounted a generally vertical but non-planar light source mounting surface having a width and a height;

ii. plural light sources arranged generally horizontally along the width of the non-planar light source mounting surface;

iii. a lens proximate and encapsulating the light sources and adapted to control the composite output pattern of the light sources to predominately outward and downward from the module relative the height of the lighting module on the vertically elevating structure;

e. so that the module produces a controlled output pattern which is elongated with a short axis extending directly out from the housing and a long axis extending to either side of the housing primarily outward and downward below horizontal relative to the lighting module, and directed so as to at least substantially illuminate the width of the pathway while not substantially illuminating the area beyond the pathway.

12. The apparatus of claim 11 wherein the elevating structure comprises a bollard-type post.

13. The apparatus of claim 11 wherein the lighting module is mounted inside the housing.

14. The apparatus of claim 11 wherein the lighting module comprises a sub-assembly of the base, light sources, and lens.

15. The apparatus of claim 11 wherein the mounting surface has a plurality of surfaces at different orientations relative a plane normal to the base.

16. The apparatus of claim 15 wherein a light source is associated with each of the surfaces of the light source mounting surface.

17. The apparatus of claim 16 wherein the light sources each have an optical axis that diverge radially from each other and the fixture.

18. The apparatus of claim 17 wherein the lens is semi-cylindrical.

* * * * *